United States Patent [19]

Isii

[11] Patent Number: 4,619,176

[45] Date of Patent: Oct. 28, 1986

[54] AUTOMATIC ACCOMPANIMENT APPARATUS FOR ELECTRONIC MUSICAL INSTRUMENT

[75] Inventor: Sigeki Isii, Hamakita, Japan

[73] Assignee: Nippon Gakki Seizo Kabushiki Kaisha, Hamamatsu, Japan

[21] Appl. No.: 741,714

[22] Filed: Jun. 6, 1985

Related U.S. Application Data

[63] Continuation of Ser. No. 551,269, Nov. 14, 1983, abandoned.

[30] Foreign Application Priority Data

Nov. 20, 1982 [JP] Japan ..... 57-204000

[51] Int. Cl.[4] ..... G10F 1/00

[52] U.S. Cl. ..... 84/1.03; 84/1.24; 84/DIG. 22; 84/DIG. 12

[58] Field of Search ..... 84/1.01, 1.03, 1.24, 84/DIG. 12, DIG. 22

[56] References Cited

U.S. PATENT DOCUMENTS

| | | | |
|---|---|---|---|
| 4,328,732 | 5/1982 | Takeda et al. | 84/1.03 X |
| 4,339,978 | 7/1982 | Imamura | 84/1.03 |
| 4,355,559 | 10/1982 | Uya et al. | 84/1.03 |
| 4,449,437 | 5/1984 | Cotton, Jr. et al. | 84/1.01 |

*Primary Examiner*—Forester W. Isen

*Attorney, Agent, or Firm*—Spensley Horn Jubas & Lubitz

[57] ABSTRACT

In an automatic accompaniment apparatus for electronic musical instrument capable of automatically generating accompaniment tones such as base tones, chord tones and arpeggio tones, arrangement is provided so that, at each time of depressing keys on an accompaniment keyboard, accompaniment key data for accompaniment tones which may possibly be sounded, are previously formed and secured, and the selected ones of the key data for the selected accompaniment are outputted at accompaniment tone generating timings synchronous with the rhythm. Thus bass tone, chord tones, arpeggio tones etc. may be generated in sufficient synchronous relation with a selected rhythm even by adopting a time-divisional processing using a low-speed compact computer such as a micro-computer.

11 Claims, 23 Drawing Figures

AUTOMATIC ACCOMPANIMENT APPARATUS FOR ELECTRONIC MUSICAL INSTRUMENT

This application is a continuation of Ser. No. 551,269, filed Nov. 14, 1983, now abandoned.

BACKGROUND OF THE INVENTION (a) Field of the invention

The present invention relates to an automatic accompaniment apparatus for electronic musical instruments, which is capable of automatically producing accompaniment tones such as bass tones and arpeggio tones.

(b) Description of the prior art

An automatic accompaniment, in general, means such a performance that accompaniment tones are prepared by circuitries in the instrument upon respective depressions of the keys, and that, thereafter, they are sounded at such timings as required in accordance with the predetermined rhythm to automatically produce, for example, bass tones and arpeggio tones.

As a typical conventional automatic bass accompaniment apparatus, there has been proposed one which is arranged so that, at each time of depression of a chord, a root note data representing the root note of the chord and interval data read out from the memory are, for example, respectively added together to form respective bass key data, and that bass tones are respectively and sequentially produced in accordance with these bass key data. Also, as a typical conventional automatic arpeggio accompaniment apparatus, there has been proposed one which is arranged so that at each time of depression of a chord, depressed key data of the depressed chord (for example C, E, G) are written in the memory, and that the depressed key data requiring sounding are searched successively from the low pitch note side to the high pitch note side, using, as trigger signals, the pulses of a certain period (for example, a time length of a 16th note), and that the depressed key data thus obtained from the search are given an appropriate processing such as an octave processing, to thereby produce arpeggio tones.

The above-mentioned automatic bass accompaniment apparatus and arpeggio accompaniment apparatus are effective for use in a circuit system wherein both the bass tone generation and the arpeggio tone generation are performed in parallel. However, in order to use such apparatuses in a system wherein the bass tone generation and the arpeggio tone generation are processed time-divisionally (i.e. in series), especially in a system wherein they are subjected to time division processing by using a micro-computer, the computation processing requires an undesirably lengthy time, so that there is a drawback in that it is difficult to generate both bass tones and arpeggio tones in synchronism with the selected rhythm. More particularly, in an ordinary electronic musical instrument, chord tones, bass tones, arpeggio tones and so forth should be generated in synchronism with rhythm tones. If, however, an undesirably lengthy time is required for the computation processing intended for the generation of the respective tones, the result is that the bass tones, arpeggio tones and other accompaniment tones undesirably will become generated with delays for the given rhythm timings.

In order to solve these problems mentioned above, there may be used a computer which is capable of performing high-speed computation. However, the incorporation of such a computer in an electronic musical instrument is non-realistic in view of, for example, cost and space.

SUMMARY OF THE INVENTION

It is, therefore, an object of the present invention to provide a new automatic accompaniment apparatus which is able to generate such tones as bass and arpeggio in sufficiently satisfactory synchronism with a given rhythm even when there is employed a time divisional processing by a low-speed small-size computer such as a micro-computer.

The automatic accompaniment apparatus of an electronic musical instrument according to the present invention intended to attain the above-mentioned object is arranged so that, at the time of the depression of accompaniment keys, there are formed and secured (i.e. prepared) key data for the accompaniment tones which have the possibility of being sounded, and at respective accompaniment tone generating timings which are synchronized with the rhythm, desired accompaniment tones such as bass tones or arpeggio tones are generated only by selecting the already prepared key data, to thereby materialize the proper timings of sounding.

DETAILED DESCRIPTION OF THE PREFERRED EMBODIMENTS

Figure 1A:
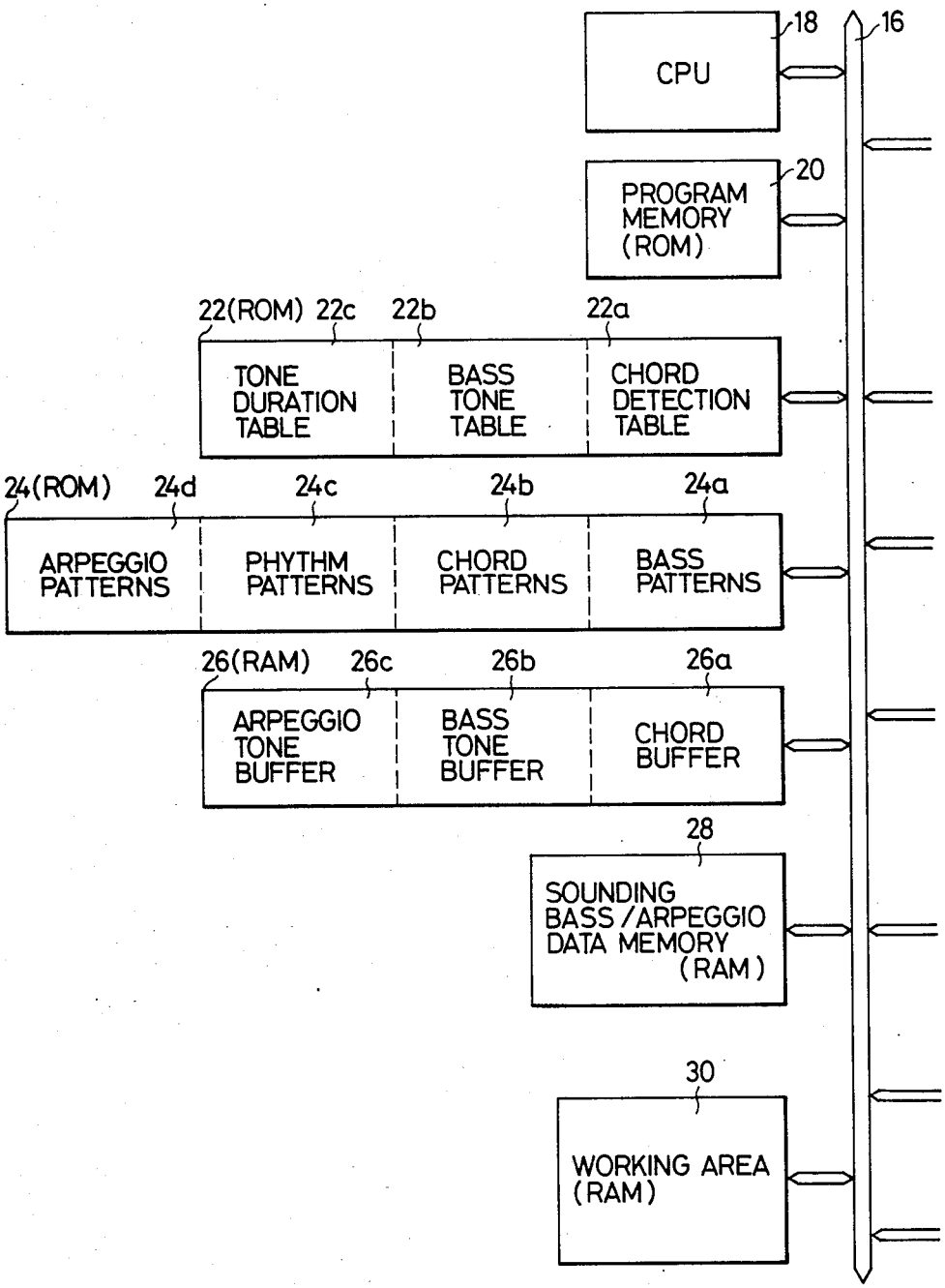
FIGS. 1A, 1B and 1C are, in combination, a block diagram of an electronic musical instrument representing an embodiment of the present invention.
Figure 1B:
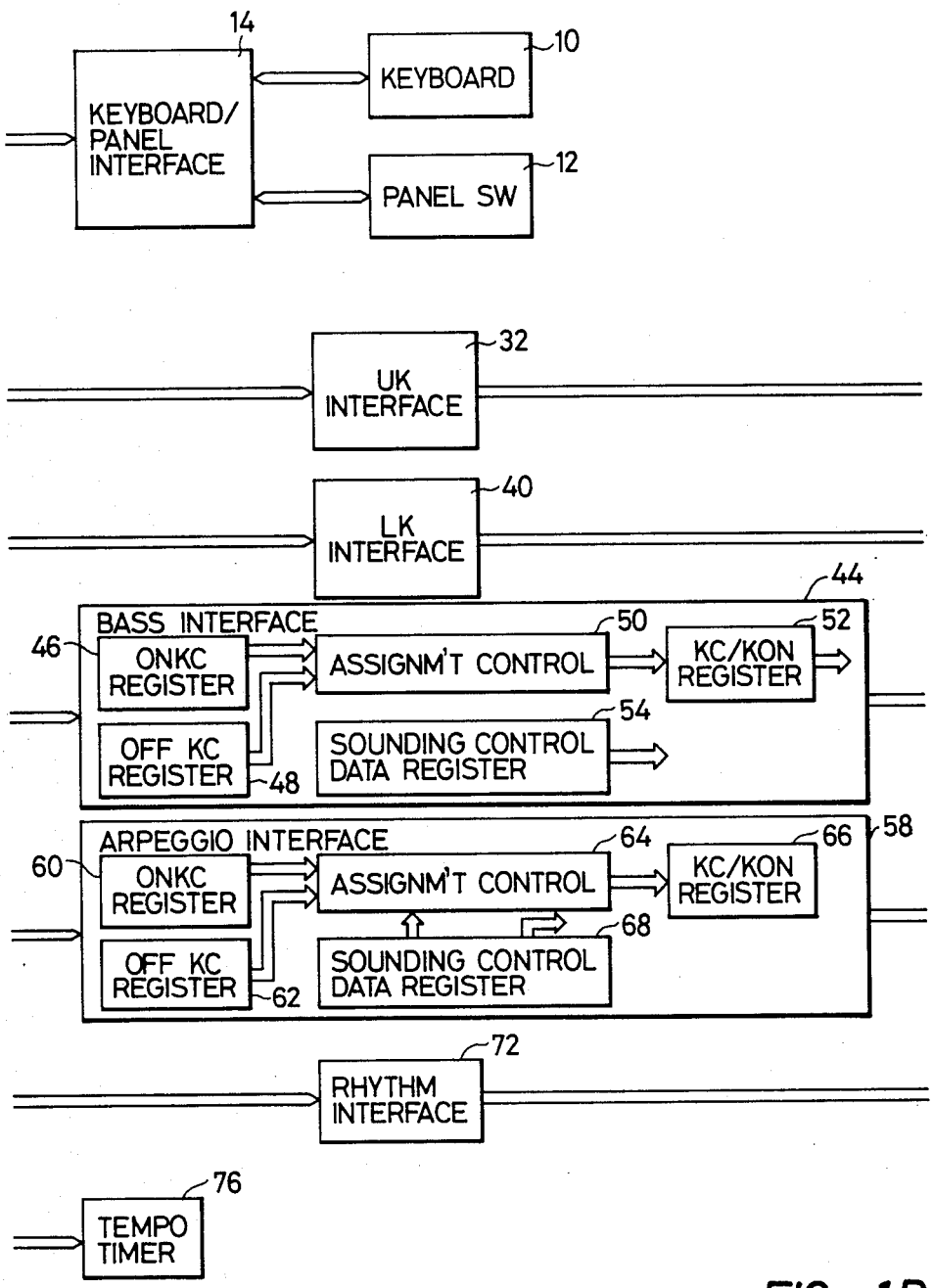
Figure 1C:
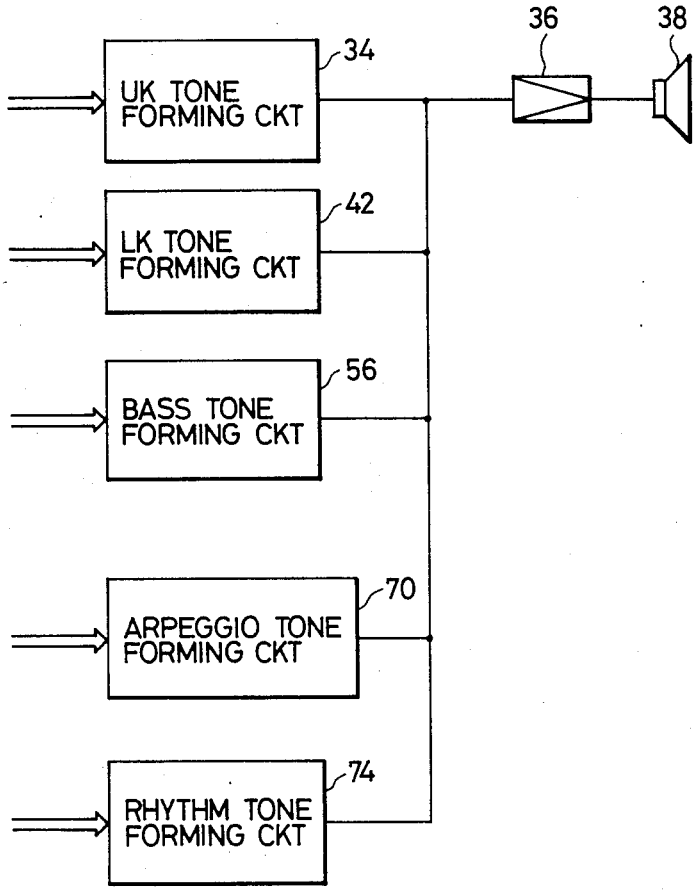

FIGS. 1A, 1B and 1C show, in combination, an electronic musical instrument of an embodiment of the present invention. This electronic musical instrument is arranged so that, by the aid of a micro-computer, the generation of, for example, melody tones, chord tones, bass tones, arpeggio tones and rhythm tones is controlled.

A keyboard unit 10 includes an upper keyboard UK, a lower keyboard LK and a pedal keyboard PK. A panel switch (SW) circuit 12 contains a number of manipulation buttons or knobs arranged on the face of a panel, including UK/LK tone color selection switches, a rhythm start/stop switch, rhythm selection switches, a tempo control, walking bass selection switches, arpeggio selection switches, and mode selection switches.

A keyboard/panel interface 14 is coupled, via a busbar 16, to a central processing unit CPU 18. This CPU 18 is arranged to make, via the interface 14, a scanning of the keys of the respective keyboards of the keyboard unit 10 as well as the various switches of the panel switch circuit 12, to thereby detect the key state information and the switch state information.

The musical tone generation controlling operation by the CPU 18 is controlled by a program stored in a program memory 20 which is comprised of a ROM (Read Only Memory), the details of which will be described later.

A memory table which is generally indicated at 22 and which is comprised of a ROM contains a chord detection table 22*a*, a bass tone table 22*b* and a tone duration table 22*c*. Of these tables, the chord detection table 22*a* stores chord name data corresponding to the lower key (LK) depression state separately for the fingered chord (FC) mode and for the single finger (SF) mode. Here, each of the chord name data is comprised of combination of a tonic data corresponding to the root note of a chord and chord type data corresponding to such a chord type as major or minor, etc. In case of FC mode, the root note and the chord type are determined in correspondence to the actual depression of chord keys on the lower keyboard LK. In case of SF mode, on the other hand, the root note is determined in correspondence to the highest note or the lowest note key among the depressed keys on the lower keyboard LK, and the chord type is determined in accordance with the state of those keys other than the root note key (e.g. the kind of key such as a sharp key or a natural key or the number of the depressed keys). It should be noted here that the designation of the chord type in case of SF mode may be arranged so that it is performed by the pedal keyboard PK or by separate chord type designation switches.

Figure 2:
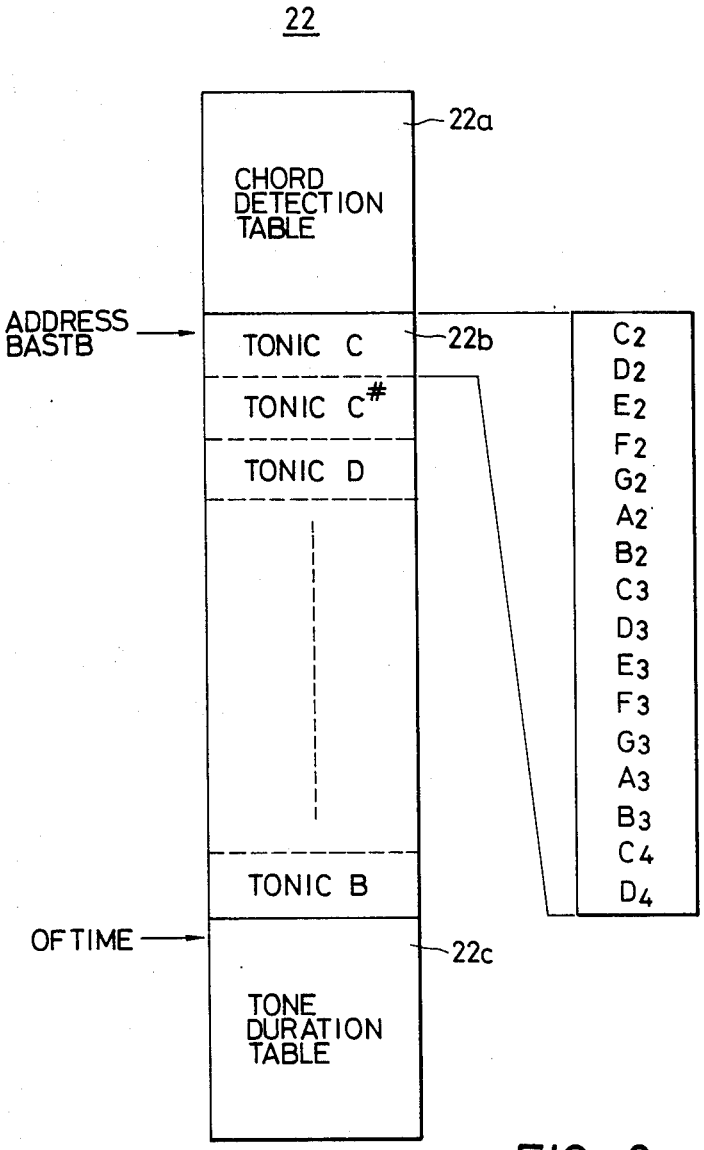
FIG. 2 is an illustration showing the arrangement of data in a memory table.

As shown in FIG. 2, the bass tone table 22*b* possesses twelve (12) memory sections corresponding to the respective ones of the tonics C, C#, D, . . . , B. Each memory section stores key code data for sixteen (16) diatonic scale notes which have the possibility of being sounded, such as $C_2$, $D_2$, $E_2$, . . . , $D_4$ in case of tonic C; and $C_2$#, $D_2$#, $F_2$, $F_2$#, $G_2$#, $A_2$#, $C_3$#, . . . in case of tonic C#.

The tone duration table 22*c* stores time length data indicative of the duration of various tones, and this table is arranged so that the time length data is read out by using, as the relative addresses, the values indicated by the tone duration data contained in the pattern data which will be described later.

A pattern memory 24 which is comprised of a ROM contains a bass pattern memory 24*a*, a chord pattern memory 24*b*, a rhythm pattern memory 24*c* and an arpeggio pattern memory 24*d*. The bass pattern memory 24*a* and the arpeggio pattern memory 24*d* store, as shown in FIG. 3, pattern data for respective kinds of rhythms such as march, swing, . . . , waltz.

More specifically, the bass pattern data which is shown of its one example with respect to march rhythm is such that the data for one tone is comprised of two-byte data, of which the first byte contains a two-bit tone volume data ACC, a one-bit mute data M, a non-use ("0") one-bit, and a four-bit sounding timing data TMG, and the second byte includes a four-bit tone pitch data, and a four-bit tone duration data.

Here, the tone volume data ACC is intended to add an accent to a bass tone. The mute data M is intended to control the tone color or the sustain time of a bass tone to generate a mute tone which gives a somewhat dull impression. The sounding timing data TMG is intended to indicate the sounding timing of any one of 0~11 within one beat (corresponding to a single quarter note), and the sounding timing values 0~11 correspond to the count values 0~11 of an intra-beat timing counter which will be described later. The tone pitch data is intended to enable the reading-out of a key data corresponding to the specific bass tone which is to be sounded, by designating any one of the addresses of 0~15 contained in the bass tone buffer which will be described later. The tone duration data is intended to indicate, by a digital value corresponding to the note type, the "on" time from the rise up to the start of sustain of a bass tone which is to be sounded (corresponding to the key-on time in case of pedal keyboard PK), and this digital value corresponds to an address of the tone duration table 22*c*. More particularly, the tone duration data per se only indicates to which note the "on" time of the bass tone corresponds. Therefore, in order to know the length of the "on" time of the bass tone (meaning the tone duration), it is necessary to read out the time length data of the tone duration table 22*c* based on the tone duration data.

Figure 3:
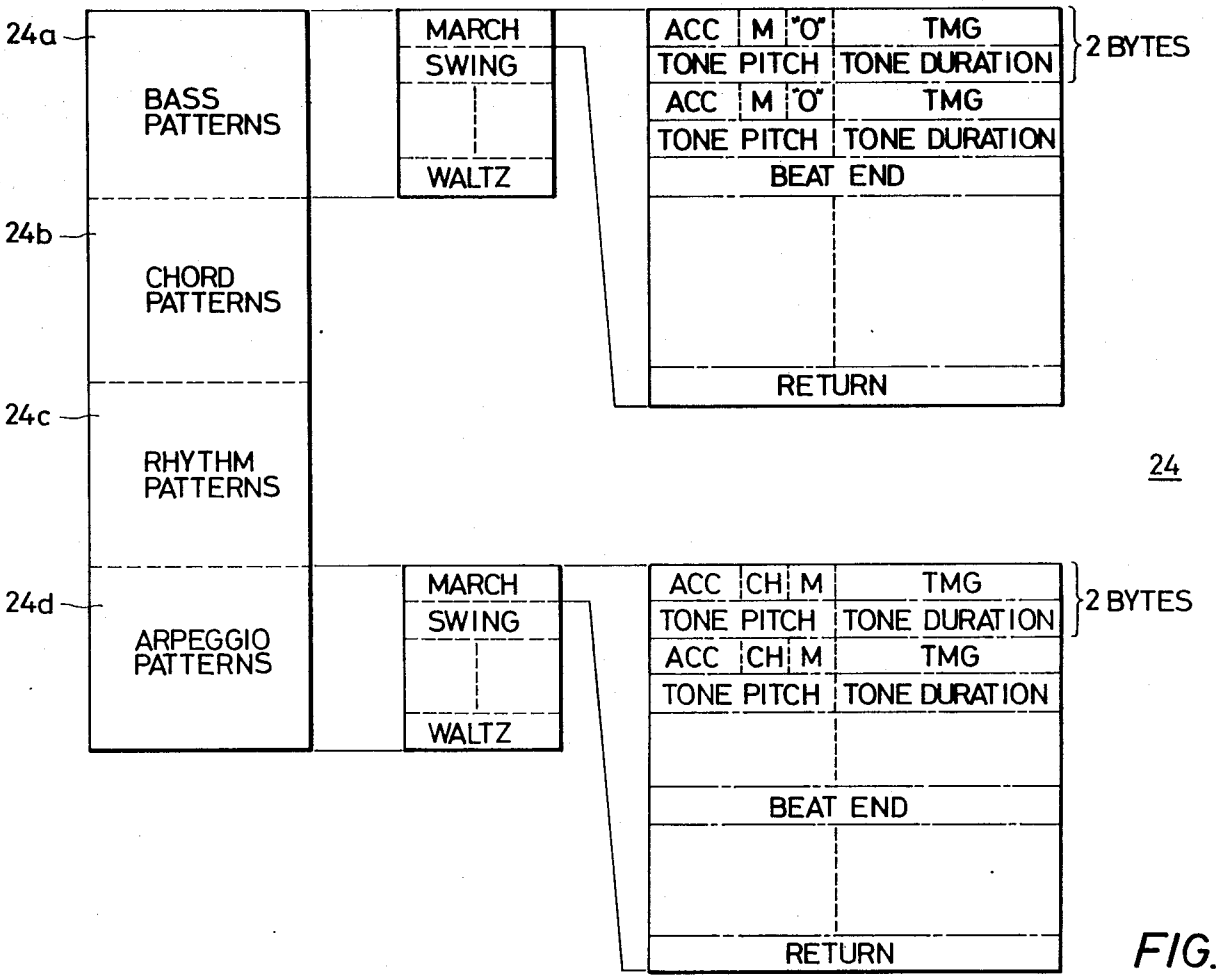
FIG. 3 is an illustration showing the arrangement of data in a pattern memory.

In case, as shown in FIG. 3, there are a plurality of bass tones which are to be sounded within a single beat, two-byte data corresponding to the respective bass tones are arranged successively, and at the end thereof is arranged a beat-end flag data ("0D" in hexadecimal notation). And, it should be noted that such arrangement as mentioned above is made in similar fashion for any required number of beats, and in each case a return flag data ("0F" in hexadecimal notation) is arranged at the end thereof.

The arpeggio pattern data, as its one example, is shown with respect to "march", is such that the data for one tone is comprised of data of two bytes, the first byte of which contains a one-bit tone volume data ACC, a two-bit channel data CH, a one-bit mute data M and a four-bit sounding timing data TMG, and the second byte includes a four-bit tone pitch data and a four-bit tone duration data.

Here, the tone volume data ACC, the mute data M, the sounding timing data TMG, the tone pitch data and the tone duration data possess functions similar to those described above, respectively. The channel data CH is intended to designate either one of the four music tone forming channels. Also, the manner of disposing the two-byte data, the beat-end flag data ("0D" in hexadecimal notation) and the return flag data ("0F" in hexadecimal notation) is similar to that for the abovesaid bass pattern data.

The chord pattern memory 24*b* stores chord pattern data containing sounding timing data, sounding controlling data for tone volume, tone color and so forth, and tone duration data. The manner of disposing these data is similar to that for the above-mentioned bass pattern data. Also, the rhythm pattern data memory 24*c* stores rhythm pattern data containing sounding timing data, musical instrument type designating data, and sounding controlling data for tone volume, tone color and so forth, and the manner of disposing these data is similar to that for the above-mentioned bass pattern data.

Figure 4:
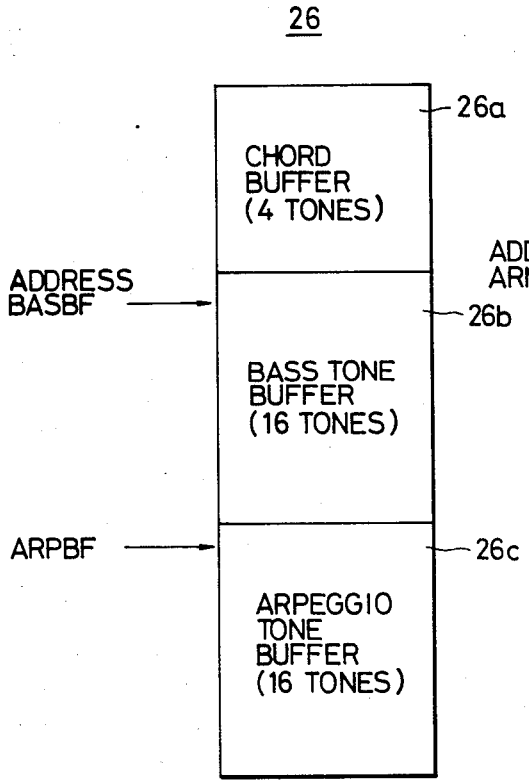
FIG. 4 is an illustration of construction of an accompaniment tone buffer.

An accompaniment tone buffer 26 which is comprised of a RAM (Random Access Memory) contains a chord buffer 26*a*, a bass tone buffer 26*b* and an arpeggio tone buffer 26*c*. As shown in FIG. 4, the chord buffer 26*a* is adapted to be able to store chord-tone key code data for four (4) tones, and the bass tone buffer 26*b* is adapted to be able to store bass-tone key code data for 16 tones, and the arpeggio tone buffer 26*c* is adapted to be able to store arpeggio-tone key code data for 16 tones.

Figure 5:
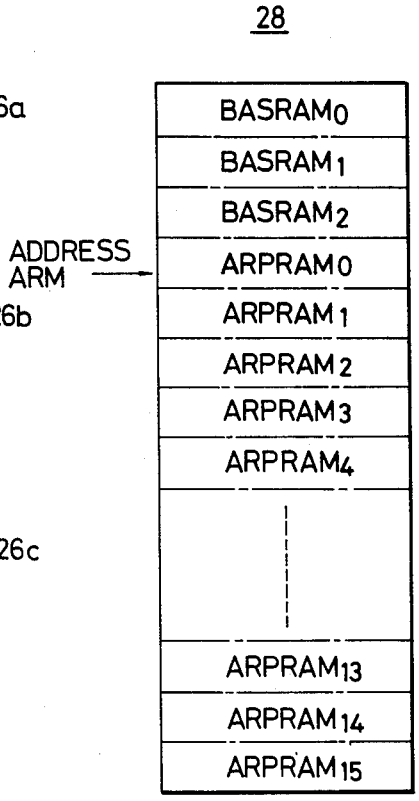
FIG. 5 is an illustration of construction of a sounding bass/arpeggio data memory.

A sounding base/arpeggio data memory 28 which is comprised of a RAM contains three memory sections $BASRAM_0 \sim BASRAM_2$ for bass and 16 memory sections $ARPRAM_0 \sim ARPRAM_{15}$ for arpeggios as shown in FIG. 5, and is utilized at the time of the base/arpeggio sounding processing (FIGS. 14A~17) which will be described later. The $BASRAM_0$ is intended to store an off-timing data, and the $BASRAM_1$ is intended to store a key code data, and the $BASRAM_2$ is intended to store a sounding controlling data (tone volume data ACC and mute data M).

Also, $ARPRAM_0 \sim ARPRAM_3$, $ARPRAM_4 \sim ARPRAM_7$, $ARPRAM_8 \sim ARPRAM_{11}$ and $ARPRAM_{12} \sim ARPRAM_{15}$ are provided to correspond to the first, second, third and fourth music tone forming channels, respectively. The $ARPRAM_0$, $ARPRAM_1$, $ARPRAM_2$ and $ARPRAM_3$ are adapted, respectively, to store an on-key code data, an off-timing data, and off-key code data and a sounding controlling data (tone volume data ACC, mute data M and channel data CH), for the first music tone forming channel. Such share of memory applies also similarly to the $ARPRAM_4 \sim ARPRAM_7$ for the second music tone forming channel, and to the $ARPRAM_8 \sim ARPRAM_{11}$ for the third music tone forming channel, and to the $ARPRAM_{12} \sim ARPRAM_{15}$ for the fourth music tone forming channel, respectively.

Figure 6:
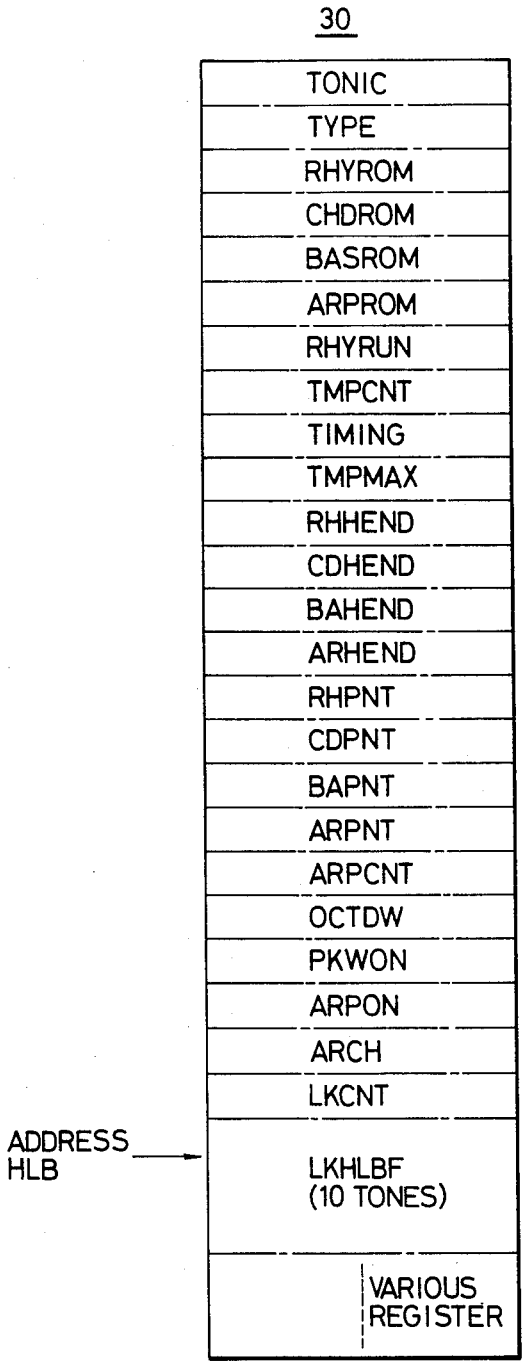
FIG. 6 is an illustration showing the arrangement of registers in the working area.

The working area 30 consisting of a RAM contains various kinds of flags, registers and so forth. The arrangement of those registers related to the working of the present invention is as shown in FIG. 6. More specifically, TONIC represents a register for writing-in a tonic data corresponding to the root note of a detected chord. TYPE represents a register for writing-in a chord type data corresponding to a detected chord type. RHYROM, CHDROM, BASROM and ARPROM are registers for setting the pattern leading addresses of the rhythm pattern memory 24*c*, the chord pattern memory 24*b*, the bass pattern memory 24*a* and the arpeggio pattern memory 24*d*, respectively, in accordance with a selected type of rhythm.

RHYRUN represents a rhythm run flag which is set at the time of a rhythm start, and reset at the time of a rhythm stop. TMPCNT represents an intra-beat timing counter which counts the timing (interruption timing) number within a beat in such a way that the count value steps from 0 to 11 within a single beat and repeats the same for every new beat. TIMING represents an intrameasure timing counter which counts the timing (interruption) number within a beat in such a way that the count value steps from 0 to 35 (in case of three beats or triple meter) or from 0 to 47 (in case of four beats or quadruple meter) within a single measure and repeats the same for every new measure. TMPMAX represents a register in which is set the maximum timing value of 36 (in case of three beats) or of 48 (in case of four beats) for the counter TIMING. It should be noted that the determination of three beats or four beats is made in accordance with the type of the rhythm selected.

RHHEND, CDHEND, BAHEND and ARHEND represent beat-end flags for rhythm, chord, bass and arpeggio, respectively, and they are set at the time of detection of a corresponding beat-end flag data. Also, RHPNT, CDPNT, BAPNT and ARPNT represent address pointers which are utilized when data are read out from the rhythm pattern memory 24*c*, the chord pattern memory 24*b*, the bass pattern memory 24*a* and the arpeggio pattern memory 24*d*, respectively, and they indicate relative addresses from the leading edge of the respective patterns.

ARPCNT represents a register in which is set the number of arpeggio tones which are to be sounded. In this instant embodiment, there are provided four music tone forming channels for arpeggio, and therefore the number of the arpeggio tones for being sounded is limited to four or less.

Figure 12A:
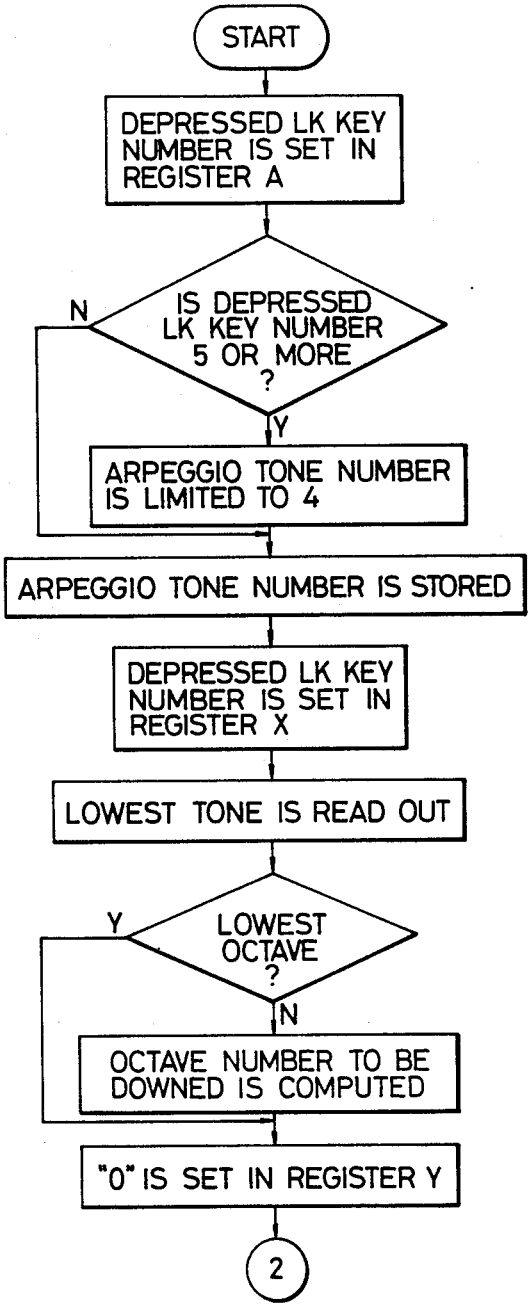
FIGS. 12A and 12B are, in combination, a flow chart of arpeggio tone setting sub-routine.
Figure 12B:
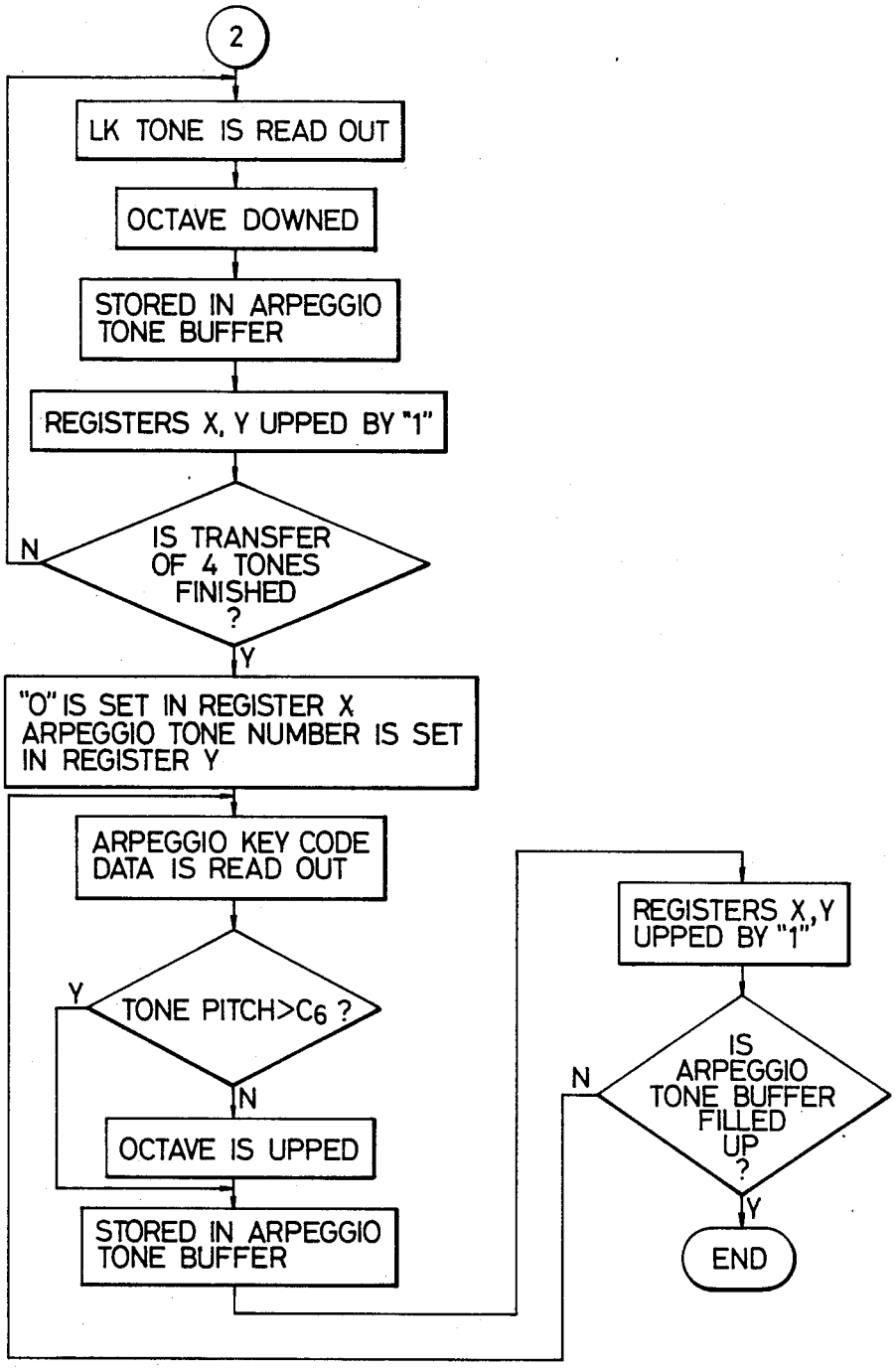

OCTDW represents a register in which is set the octave number which requires to be downed in the arpeggio tone setting processing (FIGS. 12A and 12B). PKWON represents a state flag of the walking base selection switch. ARPON represents a state flag of the arpeggio selection switch. ARCH represents a register in which is written a data for designating the music tone forming channel in the processing of conversion into arpeggio (FIGS. 15A and 15B) (in case of the first channel, "00" in hexadecimal notation; in case of the second channels, hexadecimal "04"; in case of the third channels, hexadecimal "08"; and in case of the fourth channels, hexadecimal "0C"). LKCNT represents a register in which is set the number of the depressed keys on the lower keyboard LK. LKHLBF represents a buffer register which is capable of writing-in key code data for ten (10) tones and corresponding to the depressed keys on LK by arraying in successive order from the data of higher pitch keys. It should be understood here that the working area 30 contains various other registers than those mentioned above.

Here, the manner of determining key codes will be described. A key code KC is indicated by the sum of octave code OC and note code NC. The octave code OC and the note code NC are as shown in Table 1 and Table 2, respectively.

TABLE 1

| Octave | Tone range | Code (hexadecimal) |
|---|---|---|
| $OC_1$ | $C_2 \sim B_1$ | 00 |
| $OC_2$ | $C_3 \sim B_3$ | 10 |
| $OC_3$ | $C_4 \sim B_4$ | 20 |
| $OC_4$ | $C_5 \sim B_5$ | 30 |
| $OC_5$ | $C_6 \sim B_6$ | 40 |
| $OC_6$ | $C_7$ | 50 |

TABLE 2

| Note name | Code (hexadecimal) |
|---|---|
| C | 1 |
| C# | 2 |
| D | 3 |
| D# | 4 |
| E | 5 |
| F | 6 |
| F# | 7 |
| G | 8 |
| G# | 9 |

TABLE 2-continued

| Note name | Code (hexadecimal) |
|---|---|
| A | A |
| A# | B |
| B | C |

According to Table 1 and Table 2 mentioned above, for example $C_2$, $C_3$, $C_4$, $B_2$ and $B_4$ are indicated by hexadecimal "01", "11", "21", "0C", "1C" and "2C", respectively. It should be noted here that hexadecimal "D", "E" and "F" following hexadecimal "C" and the hexadecimal "0" are not used as note codes, but that hexadecimal "0D" and "0F" are used in beat-end flag data and also in return flag data, respectively, as stated above.

A UK interface 32 supplies, to a UK music tone forming circuit 34, a UK tone color data based on a panel switch manipulation and UK key data based on UK manipulation. Said circuit 34 forms UK music tone signals in accordance with the data thus supplied. These UK music tone signals are supplied to a loudspeaker 38 via an output amplifier 36, to be converted to sounds.

An LK interface 40 supplies, to an LK music tone forming circuit 42, an LK tone color data based on the panel switch manipulation and LK key data based on the LK manipulation, and this circuit 42 forms LK music tone signals in accordance with the data supplied thereto. These LK music tone signals are supplied to the loudspeaker 38 via the output amplifier 36, to be converted to sounds. The UK key data output processing via the UK interface 32 is performed according to the main routine which will be described later by referring to FIG. 7. However, the LK key data output processing via the LK interface 40 from the chord buffer 26*a* is performed according to the interruption routine which will be described later by referring to FIG. 13.

A bass interface 44 contains an on-key code (ONKC) register 46, an off-key code (OFFKC) register 48, an assignment controlling circuit 50, a key-code (KC)/key-on (KON) register 52 and a sounding controlling data register 54, and is arranged so that it will assign key data alternately to two music tone forming channels so as to be able to sustain the sounding of the bass tone proceeding to a certain bass tone which is being sounded. The key data and the sounding controlling data supplied from the bass interface 44 are supplied to a bass tone forming circuit 56, and this latter circuit 56 forms bass tone signals based on the data supplied one after another thereto. These bass tone signals are supplied to the loudspeaker 38 via the output amplifier 36, to be converted to sounds.

An arpeggio interface 58 contains an on-key code (ONKC) register 60, an off-key code (OFFKC) register 62, an assignment controlling circuit 64, a key code (KC)/key-on (KON) register 66 and a sounding controlling data register 68, and is arranged so that, in accordance with the channel data CH contained in the sounding controlling data, it assigns a key data to a pertinent one of the four music tone forming channels. The key data and the sounding controlling data coming from the arpeggio interface 58 are supplied to an arpeggio tone forming circuit 70, and this circuit 70 forms arpeggio tone signals based on the data supplied thereto. These arpeggio tone signals are supplied one after another to the loudspeaker 38 via the output amplifier 36, to be converted to sounds.

A rhythm interface 72 supplies, to a rhythm tone forming circuit 74, data for designating the types of the musical instruments which are to sound and sounding controlling data, and said circuit 74 forms rhythm tone signals in accordance with the data supplied thereto. These rhythm tone signals are supplied to the loudspeaker 38 via the output amplifier 36, to be converted to sounds.

The bass data output processing via the bass interface 44 from the bass tone buffer 26*b*, the arpeggio data output processing via the arpeggio interface 58 from the arpeggio tone buffer 26*c*, and the rhythm data output processing via the rhythm interface 72 are all performed in accordance with the interruption routine which will be described later with respect to FIG. 13.

A tempo timer 76 is intended to generate twelve (12) timing pulses within a single beat in accordance with a tempo which has been set by the tempo control knob, and to apply an interruption to the main routine 12-times within a single beat in accordance with each pulse.

Main Routine

Figure 7:
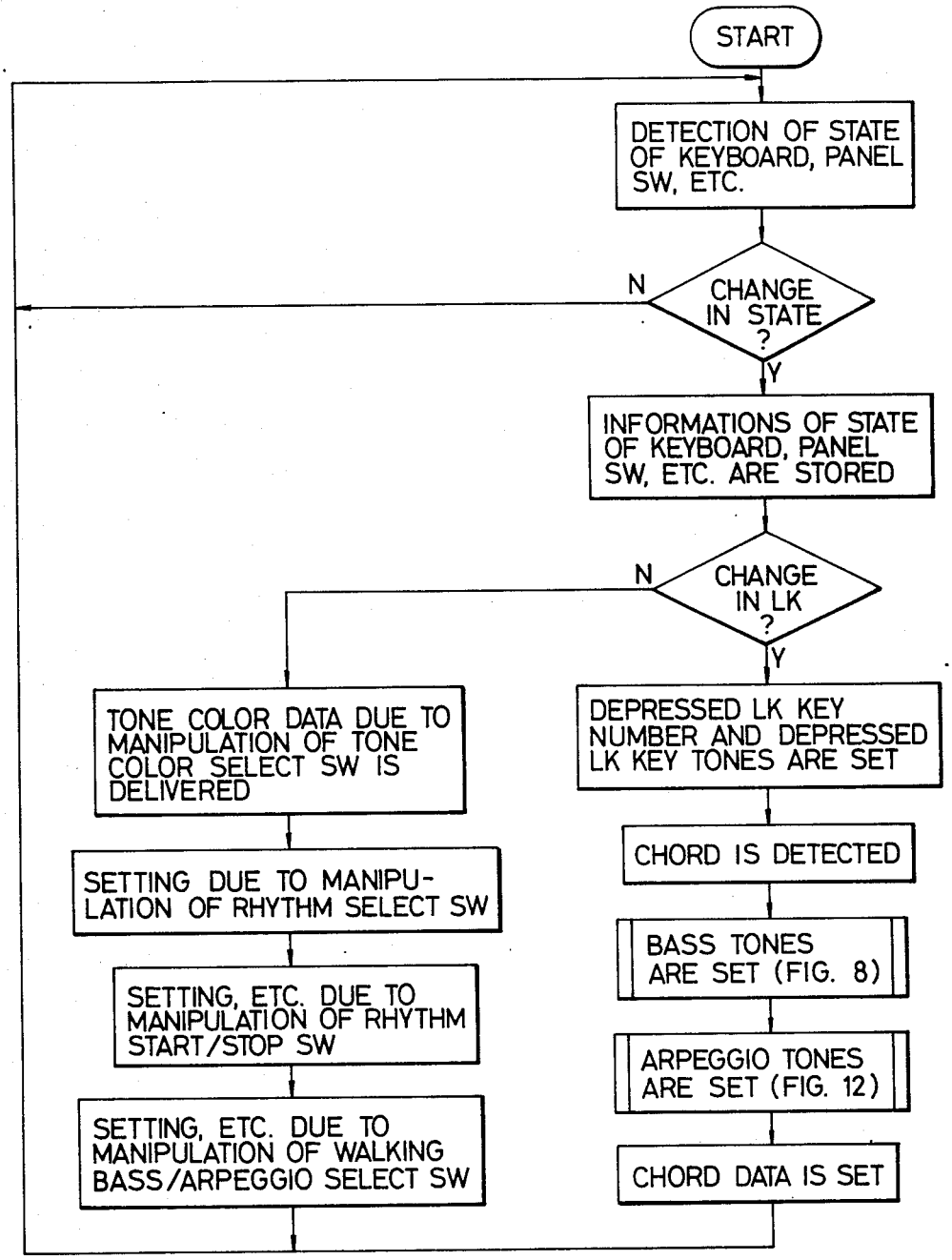
FIG. 7 is a flow chart of main routine.

Next, the processing by main routine will be described by referring to FIG. 7. Upon turning-on the power supply switch not shown, the processing by main routine starts, and the respective keyboards, the respective panel switches and so forth are scanned to detect key state informations and switch state informations. And, whether or not there is any change in the state of keys, panel switches and so forth is judged. If the result of the judgment is "no" N, the scanning and the detecting operations are repeated. Also, in case the result of judgment whether there is a change in the state is "yes" Y, the state informations concerning the keyboards, panel switches and so on are stored once in the corresponding data registers in the working area 30, respectively.

Next, whether there is a change in the state of keys of the lower keyboard LK is judged. Usually, there are performed manipulation of various manipulating buttons and knobs on the panel prior to starting the depression of keys on the lower keyboard LK. In such case, the result of judgment as to whether there is a change in LK will be "no" N, and a processing based on the manipulation of the manipulating buttons and knobs on the panel is performed. That is, based on the manipulation of the UK tone color selection switch and the LK tone color selection switch, a UK tone color data is delivered from the working area 30 to the UK music tone forming circuit 34 via the UK interface 32, and also an LK tone color data is delivered to the LK music tone forming circuit 42 from the working area 30 via the LK interface 40. Also, based on the manipulation of the rhythm selection switch, leading-addresses of respective patterns are set in respective registers RHYROM, CHDROM, BASROM and ARPROM in accordance with the type of the rhythm selected. And, in the register TMPMAX is set a maximum timing value which is either 36 or 48 in accordance with the selected rhythm which may be either three beats (triple meter) or four beats (quadruple meter).

Further, based on a rhythm start by the manipulation of the rhythm start/stop switch, the rhythm run flag RHYRUN is set, and the counters TMPCNT and TIMING are cleared, and pointers RHPNT, CDPNT, BAPNT and ARPNT are cleared, and the tempo timer 76 is initialized, and the beat-end flags RHHEND, CDHEND, BAHEND and ARHEND are cleared. It should be noted here that, in case the rhythm start/stop switch is manipulated to the "stop" position, the rhythm run flag RHYRUN is cleared.

Further, based on the manipulation to turn-on the walking bass selection switch, the state flag PKWON is set. Also, based on the manipulation to turn-on the arpeggio selection switch, the state flag ARPON is set. In case either the walking bass selection switch or the arpeggio selection switch is turned off, either the state flag PKWON or ARPON is reset accordingly.

Now, when key depression on the lower keyboard LK is started, the judgment as to whether there is a change in LK becomes "yes" Y, and thus processing to set the number of the depressed keys of LK and to set the depressed key tones of LK takes place. That is, the number of keys depressed on LK is set on the register LKCNT, and concurrently those key code data corresponding to the depressed keys on LK are arrayed in successive order from the higher pitch side, and they are written in the buffer register LKHLBF.

Next, in accordance with the LK key depression state, and depending on whether the mode is FC mode or SF mode, the chord detection table 22a is referred to, and thus a chord is detected. The tonic data corresponding to the detected root note is written in the register TONIC, and concurrently the chord type data corresponding to the detected chord type is written in the register TYPE. Here, the data format in the register TONIC is arranged so that the higher four (4) bits in one byte which consists of eight (8) bits are not used, and the remaining lower four (4) bits represent the tonic note number of 1~12. Also, the data in the register TYPE, likewise, are arranged so that the higher four (4) bits are not used and the remaining lower four (4) bits represent the chord type.

Next, processing will move onto the bass tone setting sub-routine, and a bass tone key code data for sixteen (16) tones which have the possibility of being sounded in connection with the detected chord are stored in the bass tone buffer 26b. The details of this processing will be described later with respect to FIGS. 8A and 8B.

Next, the processing will move onto the arpeggio tone setting sub-routine. An arpeggio-tone key code data for sixteen (16) tones which could be sounded in connection with the detected chord are stored in the arpeggio tone buffer 26c. The details of this processing will be described later in connection with FIGS. 12A and 12B.

Thereafter, a chord data is set in the chord buffer 26a. The chord data which is set here will be key code data corresponding to the LK depressed keys in case of FC mode, and it will be key code data of the chord constituent tones of the chord which is formed in accordance with the detected root note and chord type in case of SF mode.

When the above-stated processings are completed with respect to an instance wherein there is a change in the state of the keyboards, panel switches and so forth, the processing returns to that of the detection of the state of the keyboards, panel switches and so forth, and subsequently similar steps are repeated.

Bass Tone Setting Sub-routine

Figure 8A:
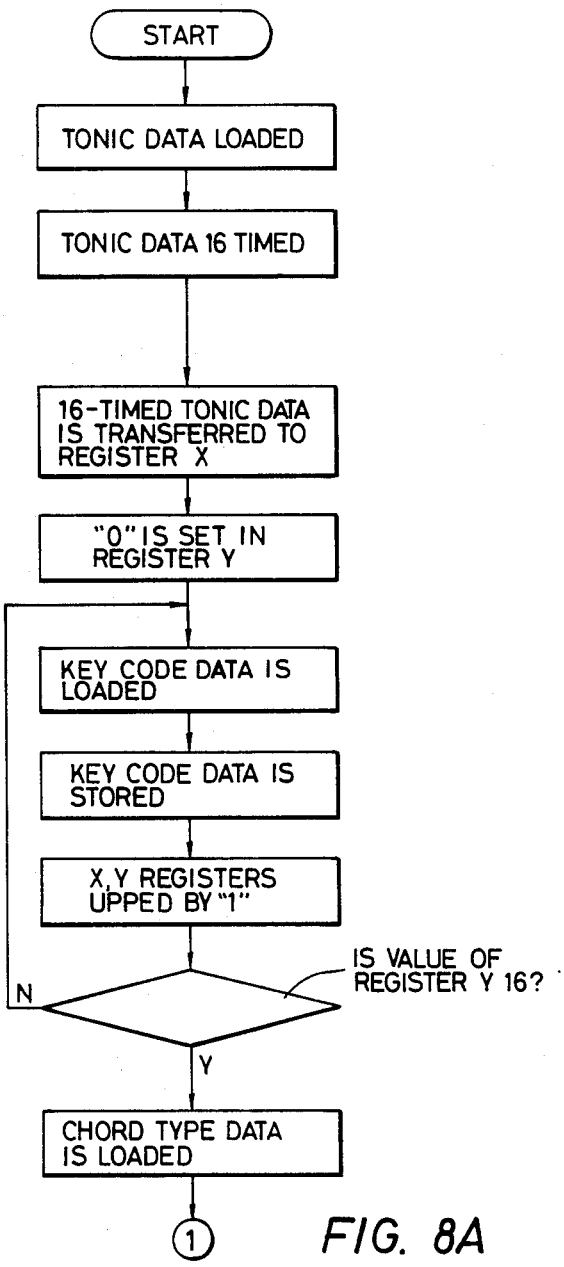
FIGS. 8A and 8B are, in combination, a flow chart of a bass tone setting sub-routine.
Figure 8B:
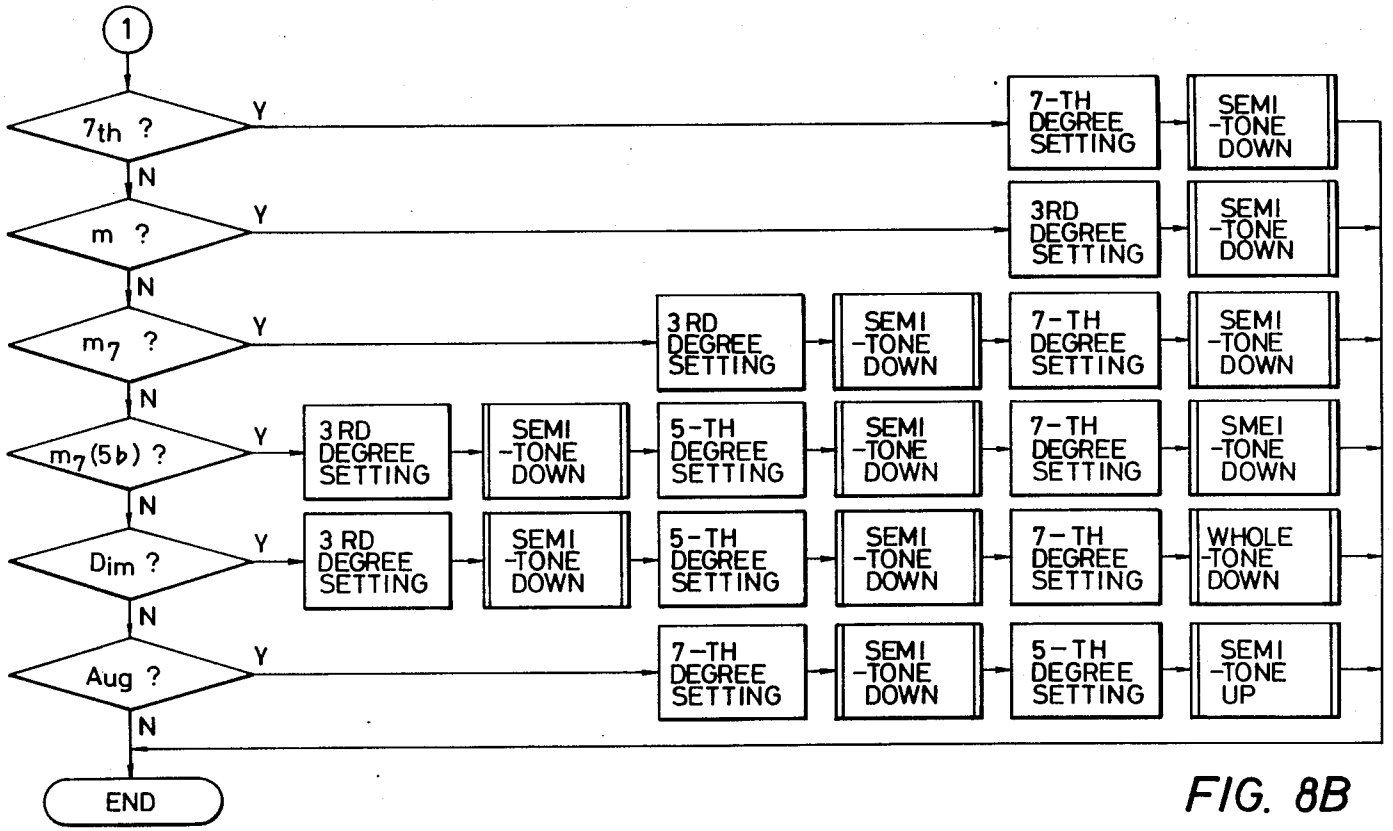

Next, description will be made of the bass tone setting sub-routine processing by referring to FIGS. 8A and 8B.

Firstly, a tonic data of the register TONIC is loaded in the register A in the CPU 18. And, by shifting the tonic data loaded in the register A in the CPU 18 left by four bits, it is multiplied to sixteen (16) times. As stated above, a tonic data is arranged so that its lower four (4) bits represent the tonic note number 1~12 (corresponding to tonic C, C♯, D, . . . , B in the bass tone table 22b). Accordingly, by multiplying the tonic data of the register A sixteen (16) times, there is obtained a 16-timed (hexadecuple) tonic data indicative of a value which may be either 16, 32, 48, . . . , 192.

Next, the 16-timed tonic data is transmitted from the register A to the register X in the CPU 18. And, by writing-"00" in hexadecimal notation in the register Y in CPU 18, the digital value "0" is set therein. This is intended to enable the writing-in of the initial key code data in the bass tone buffer 26b.

Next, as shown in FIG. 2, let us here assume that the leading address value (fixed value) of the bass tone table 22b is BASTB, and that the value of the 16-timed tonic data which has been stored earlier in the register X is X, a mathematical operation (BASTB−16+X) is carried out to obtain the address value of the key code data which is to be read out initially from the table 22b, and the key code data at this address is read out from the table 22b and it is loaded on the register A. And, when, as shown in FIG. 4, the leading address value (fixed value) of the bass tone buffer 26b is assumed to be BASBF, this latter value is added with the value of the register Y, whereby the address which is to be written initially in bass tone buffer 26b is designated, and the initial key code data coming from the register A is stored therein. The result represents that, among the key code data for sixteen (16) tones belonging to a given tonic corresponding to the root note of the detected chord, the first key code data has been transmitted via the register A from the bass tone table 22b to the bass tone buffer 26b. Thereafter, the value of the register X and the value of the register Y are upped (increased) by "one" respectively to advance the read-out address and the write-in address by "one", respectively. And, whether the value of the register Y is equal to "16" is judged, and if the result is "no" N, such a transmission of the key code data as mentioned above is repeated. Such a transmission step inclusive of the first one is repeated sixteen (16) times, and the result is that all the key code data for sixteen (16) tones belonging to the given tonic have been transferred from the bass tone table 22b to the bass tone buffer 26b.

At such time, the value of the register Y becomes sixteen (16), and the judgment whether the value of the register Y is sixteen (16) becomes "yes" Y. Therefore, the processing will next move onto that of adjusting the data in the bass tone buffer 26b in accordance with the chord type. To begin with, the chord type data of the register TYPE is loaded on the register A, and whether the value of the register A is "01" in hexadecimal notation is checked, to judge whether the chord type is "seventh", and if "yes" Y, the 7th degree tone data ("06" in hexadecimal notation) for this chord is set in the register X. And, the processing will then move over to such a semi-tone down sub-routine as will be described later with respect to FIG. 9, and the tone pitch (code value) of the key code data corresponding to the 7th degree tone in the bass tone buffer 26b is downed (decreased) by a semi-tone, and with this the processing completes.

If the result of the judgment whether it is seventh (7th) is "no" N, a check whether the value of the register A is "04" in hexadecimal notation is made, whereby whether the chord type is minor "m" is judged. If the result of this judgment is "yes" Y, the third degree tone data ("02" in hexadecimal notation) of this chord is set in the register X. And, the processing moves over to the semi-tone down sub-routine, and the tone pitch of the key code data corresponding to the third degree tone in the bass tone buffer 26b is downed by a semi-tone, and with this the processing completes.

If the result of the judgment as to "minor" is "no" N, a check is made as to whether the value of the register A is "05" in hexadecimal notation to judge whether the chord type is minor seventh ($m_7$). If the result of this judgment is "yes" Y, the third degree data is set in the register X as in the abovesaid "minor" case, and a semi-tone down sub-routine is carried out. Next, as in the case of the "seventh" at the processing stated above, the seventh degree tone data is set in the register X, and the semi-tone down sub-routine is carried out, and with this, the processing completes.

In case the judgment for "minor seventh" is "no" N, whether the value of the register A is "06" in hexadecimal notation is checked, whereby whether the chord type is minor seventh with 5th degree flat ($m_7(5b)$) is judged. If the result of this judgment is "yes" Y, the third degree tone data is set in the register X as in the case of "minor" described above, and the semi-tone down sub-routine is carried out. Next, by setting the 5th degree data ("04" in hexadecimal notation) in the register X and by carrying out the semi-tone down subroutine, the note pitch of the key code data corresponding to the 5th degree tone in the bass tone buffer 26b is downed by a semi-tone. Thereafter, like in the abovesaid "seventh" case, the 7th degree tone data is set in the register X, to carry out the semi-tone down sub-routine, and with this the processing completes.

If the result of judgment as to whether the chord type is minor seventh with 5th degree flat is "no" N, then whether the value of the register A is "07" in hexadecimal notation is checked to judge whether the chord type is "diminished" (Dim). If the result of this judgment is "yes" Y, the third degree data is set in the register X as in the case of "minor" stated above, and thus the semi-tone down sub-routine is carried out. Next, as in the abovesaid case of "minor seventh with 5th degree flat", the 5th degree data is set in the register X, and the semi-tone down sub-routine is carried out. Thereafter, the 7th degree data is set in the register X, and the processing will move on to such a whole tone down sub-routine as will be described later with respect to FIG. 11, and the tone pitch of the key code data corresponding to the 7th degree tone in the bass tone buffer 26b is subjected to "whole tone down", and with this the processing completes.

If the result of the judgment whether the chord type is "diminished" is "no" N, then whether the value of the register A is "08" in hexadecimal notation is checked to judge whether the chord type is "augumented" (Aug). If the result of this judgment is "yes" Y, the 7th degree tone data is set in the register X as in the abovesaid "seventh" case to carry out the sub-routine for semi-tone down. Next, the 5th degree tone data is set in the register X, and the processing moves on to such a semi-tone up sub-routine as will be described later in connection with FIG. 10, and the tone pitch of the key code data corresponding to the 5th degree tone in the bass tone buffer 26b is semi-tone upped, and with this the processing completes.

Figure 9:
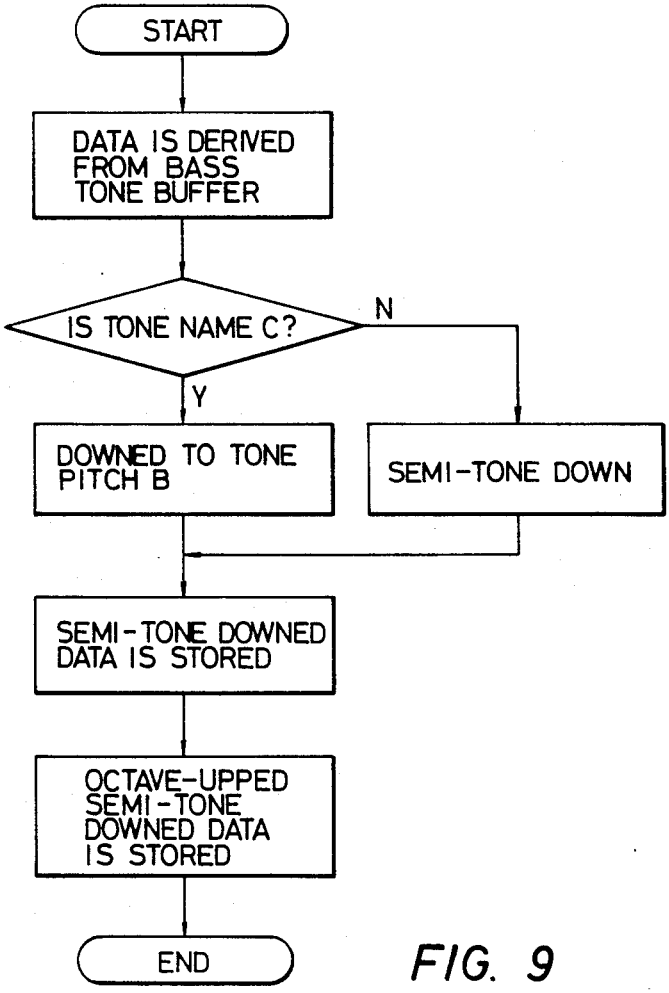
FIG. 9 is a flow chart of semi-tone down sub-routine.

If the judgment whether the chord type is "augumented" is "no" N, then it means that the chord type is either "major" (M) or sixth (6th) or "major seventh" (M7th), and the processing will end without making any such tone pitch adjustment as mentioned above. cl Semi-tone Down Sub-routine Next, description will be made of the semi-tone down sub-routine by referring to FIG. 9.

Firstly, by adding the degree value X in the register X to the address value BASBF and thereby designating the address (BASBF+X) of the bass tone buffer 26b, a key code data corresponding to the tone of the degree to be set is read out from the bass tone buffer 26b to load it on the register A. And, whether the lower four (4) bits (note code) of the key code data of the register A is "1" in hexadecimal notation is checked to judge whether the tone name is C. If the result of this judgment is "no" N, a digit "1" is subtracted from the value of the register A, to down the tone pitch by a semi-tone. Also, if the result of the judgment is "yes" Y, a digit "5" is subtracted from the value of the register A to effect a tone down to a tone pitch B. This is because of the fact that, since "0", "D"~"F" in hexadecimal notation are not used for the note codes as stated above, there is a difference of "5" between tone C ("1") and tone B ("C") which is a semi-tone below C.

Thereafter, the key code data in the register A which has been subjected to a semi-tone down is returned to the original address (BASBF+X) in the bass tone buffer 26b and is stored therein. And, by adding "10" in hexadecimal notation to the value of the register A, the octave value of the key code data of the register A is upped by "1", and this octave-upped key code data is stored in the address (BASBF+X+7) of the bass tone buffer 26b, and with this, the processing ends. As a result, both the key code data of the address (BASBF+X) in the bass tone buffer 26b and the key code data having the same tone name but being one octave (7-addresses) higher than said key code data have been semi-tone downed from their tone pitches.

Semi-tone Up Sub-routine

Figure 10:
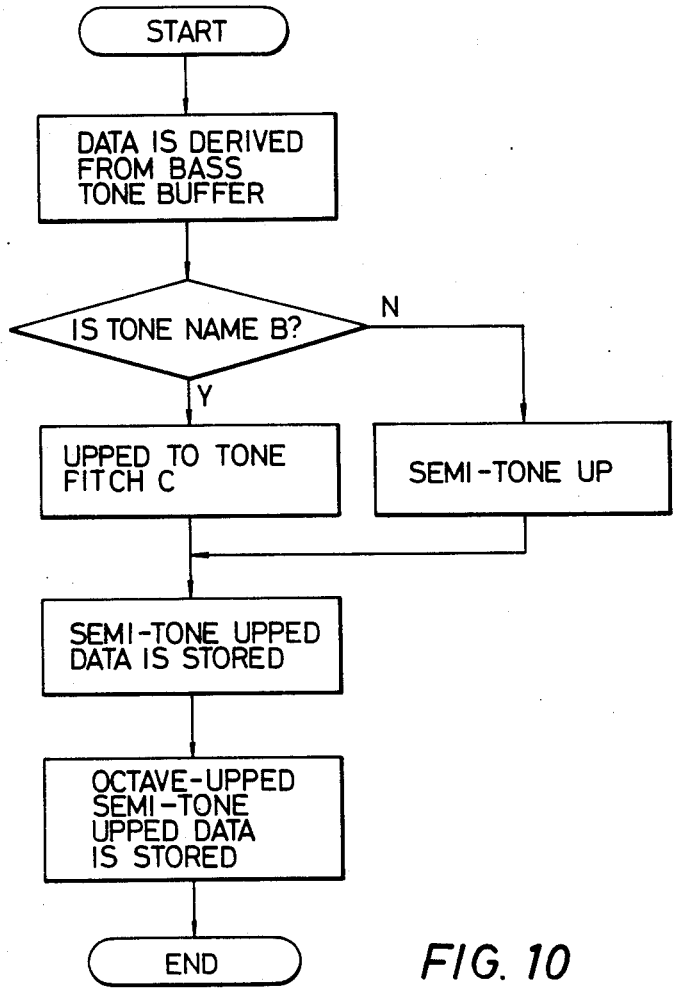
FIG. 10 is a flow chart of semi-tone up sub-routine.

Next, the processing of the semi-tone up subroutine will be described by referring to FIG. 10.

Firstly, as in the abovesaid semi-tone down processing, a key code data corresponding to the tone of the degree to be set is taken out from the bass tone buffer 26b, and it is loaded on the register A. And, a checking is made whether the lower four (4) bits of the register A represent "C" in hexadecimal notation, to judge whether the tone name is B. If the result of this judgment is "no" N, a digit "1" is added to the value of the register A, to up the tone pitch by a semi-tone. Also, if the result of the judgment is "yes" Y, a digit "5" is added to the value of the register A to up the tone pitch to C. This is a processing which is just the reverse of the abovesaid case of semi-tone down.

Thereafter, the semi-tone-upped key code data in the register A is returned to the original address (BASBF+X) in the bass tone buffer 26b, and is stored therein. And, in the manner similar to that for the abovesaid semi-tone down, the octave value of the key code data of the register A is upped by a digit "1", and this octave-upped key code data is stored in the address (BASBF+X+7) of the bass tone buffer 26b, and with this the processing ends. As a result, the key code data of the address (BASBF+X) in the bass tone buffer 26b and the key code data having the same tone name but one octave (7 addresses) higher than that of said data both now have their tone pitches upped by a semi-tone.

Whole Tone Down Sub-routine

Figure 11:
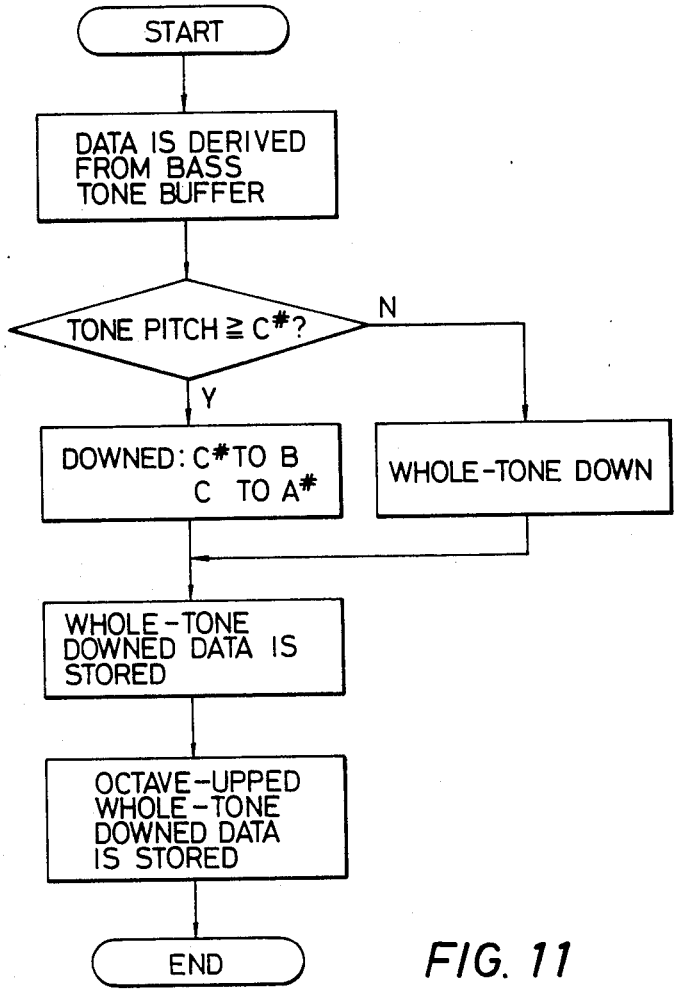
FIG. 11 is a flow chart of whole-tone down sub-routine.

Next, by referring to FIG. 11, the processing of the whole tone down sub-routine will be described.

First of all, in a manner similar to that for the above-said semi-tone down sub-routine, a key code data corresponding to the tone of the degree to be set is taken out from the bass tone buffer **26*b***, and it is loaded on the register A. And, by checking whether the lower four (4) bits of the register A are is "2" or above in hexadecimal notation, to judge whether the tone pitch is C# or higher. If the result of this judgment is "no" N, a digit "2" is subtracted from the value of the register A to down the tone pitch by a whole tone. Also, if the result of the judgment is "yes" Y, a digit "6" is subtracted from the value of the register A to down C# to B, and to down C to A#, respectively. This is because the tone pitch in this case is lower further by a semi-tone (it is "1" in note code value) than in the case of semi-tone down.

Thereafter, the whole-tone-downed key code data in the register A is returned to the original address (BASBF+X) in the bass tone buffer **26*b*, and it is stored therein. And, in a manner similar to that for the above-said semi-tone down sub-routine, the octave value of the key code data of the register A is upped by "1", and this octave-upped key code data is stored in the address (BASBF+X+7) of the bass tone buffer 26*b*, and with this the processing ends. As a result, the key code data at the address (BASBF+X) in the bass tone buffer 26*b*** and the key code data having the same tone name but one octave (7addresses) higher than that of said data have now both been subjected to a whole tone down of their tone pitches.

Arpeggio Tone Set Sub-routine

Next, by referring to FIGS. 12A and 12B, description will be made of the arpeggio tone set sub-routine.

To begin with, the data of the number of the depressed keys on LK is read out from the register LKCNT, and it is loaded on the register A, and thereby the number of the depressed keys on LK is set in the register A. And, by checking whether the value of the register A is "4" or more, to judge whether the number of the depressed keys on LK is "5" or more is judged. If the result of this judgment is "no" N, the data of the register A is stored as it is in the register ARPCNT as being indicative of the number of the arpeggio tones. Also, if the result of the judgment is "yes" Y, the value of the register A is rewritten into a numeral "4", and after thus limiting the number of the arpeggio notes to "4", the data of the register A is stored in the register ARPCNT.

Next, data concerning the number of depressed keys on LK is read out from the register LKCNT, and it is loaded on the register X, and whereby the number of the depressed keys on LK is set in the register X. And, by setting the value (fixed value) of the leading address of the buffer register LKHLBF for the abovesaid tones of LK as HLB as shown in FIG. 6, and by setting the number of the depressed keys of the register X, and thereby designating the address (HLB+X−1), a key code data corresponding to the lowest tone is read out from the register LKHLBF, and this is loaded in the register A. In this instance, a key code data corresponding to the plurality of depressed keys on LK has been stored in the register LKHLBF in such a way that the data is arrayed in the high-to-low order so that a highest tone data comes at the leading address HLB. Accordingly, by designating the address (HLB+X−1) in such a manner as described above, it becomes possible to read out a key code data corresponding to the lowest tone among those depressed keys on LK.

Next, whether the value of the register A is smaller than "10" in hexadecimal notation is checked, and judgment is made whether the lowest tone belongs to the lowest octave. If the result of this judgment is "no" N, the number of the octaves which are to be downed is computed, and it is inputted into the register OCTDW. That is, it is desired that those arpeggio notes starting with the ones belonging to the lowest octave of the tone range of LK be inputted to the arpeggio tone buffer **26*c***, and accordingly "00" of hexadecimal notation (lowest octave in the tone sounding range) is subtracted from the higher four (4) bits (lowest depressed key octave) of the register A, to thereby obtain the difference in octave, and this difference is written in the register OCTDW as the number of octaves which are to be downed.

After completion of such write-in step, or after the judgment whether the octave is the lowest one, "00" is written in the register Y in hexadecimal notation, and a digital value "0" is set. This is intended to enable the initial arpeggio key code data to be written in the arpeggio tone buffer **26*c***.

Next, by reading out the initial key code data ( corresponding to the lowest tone) from the register LKHLBF by designating an address (HLB+X−1), it is loaded in the register A. And, by subtracting the value of the register OCTDW from the value of the register A, there is given an adjustment to effect an octave-down, and this adjusted data is set in the register A.

Next, the key code data of the register A is stored in the arpeggio tone buffer **26*c*. The write-in address at such time is designated by (ARPBF+Y) if the leading address value (fixed value) of the buffer 26*c* is assumed to be ARPBF and the value of the register Y is assumed to be Y as shown in FIG. 4. However, as stated above, since the value of the register Y is "0", the leading address ARPBF of the buffer 26*c*** will become the initial write-in address.

Next, the values of the register X and of the register Y are upped by a digit "1", respectively, to advance the read-out address and the write-in address by "1", respectively.

Thereafter, by checking whether the value of the register Y is greater than "3", it is determined whether the transfer of the key code data for four (4) tones has ended. If the result of this judgment is "no" N, such a data transfer step from the register LKHLBF to the arpeggio tone buffer **26*c* as mentioned above is repeated. And, repeating such a data transfer step inclusive of the first one four (4) times, this represents that key code data for four (4) tones have been stored in the arpeggio tone buffer 26*c***, and the judgment whether the transfer of four (4) tones has been finished will become "yes" Y.

In such a data transfer processing as mentioned above, it will be noted that, even in case the number of the depressed keys on LK (the value of the register X) is greater than "4", there are stored in the arpeggio tone buffer **26*c* only those key data of no more than four (4) tones counting from the low tone side in the register LKHLBF. If the number of the depressed keys on LK is four (4), key data for four (4) tones in the register LKHLBF is stored in the buffer 26c. In case, however, the number of the depressed keys on LK is smaller than four (4), e.g. two (2), there is also stored in the buffer 26c** key data for two tones which are irrelevant and not contained in the register LKHLBF in addition to the two depressed key data to fill the four-tone space. However, such irrelevant data are erased in the subsequent data write-in processing, and accordingly it provides no problem.

Now, when the judgment whether the transfer of four (4) tones has ended becomes "yes" Y, "00" in hexadecimal notation is written in the register X and thus a digital value "0" is set, and concurrently the number of arpeggio tones is set in the register Y from the register ARPCNT.

Next, by designating an address (ARPBF+X), a first key code data (corresponding to the highest pitch tone) is read out from the arpeggio buffer 26c, and it is inputted in the register A. And, by checking whether the value of the register A is greater than "41" in hexadecimal notation, to judge whether the tone pitch of the data of the register A is higher than $C_6$ note. This is intended so that the tone pitches of the respective tones are upped octave by octave until the highest octave is reached for each tone, and when the highest octave is reached, the same octave is to be repeated thereafter. If the result of this judgment whether the tone pitch is higher than $C_6$ is "yes" Y, no octave-up processing is required, and accordingly the key code data of the register A is stored as it is (i.e. without undergoing an alteration of octave) in the address (ARPBF+Y) of the arpeggio tone buffer 26c. Also, if the result of judgment is "no" N, "10" in hexadecimal notation is added to the value of the register A to correct this latter value for one octave up, and this modified data is stored in the address (ARPBF+Y) of the buffer 26c.

Here, the write-in address of the arpeggio tone buffer 26c is designated by (ARPBF+Y), and accordingly, as stated above, even if the number of the depressed keys on LK (i.e. the value Y of the register Y) is "2", the abovesaid irrelevant data are substituted by the key code data which are freshly written in, so that such irrelevant data will not remain in the buffer 26c.

Next, the values of the register X and of the register Y are upped by "1" respectively, to advance the read-out address and the write-in address by "1" respectively.

Thereafter, whether the value of the register Y is greater than "15" is checked, and thus whether the arpeggio tone buffer 26c is filled up fully with key code data is judged. If the result of judgment is "no" N, such data reading-out and storing operations as those mentioned above are repeated. And, by repeating such data reading-out and storing operations including the first one 16 $Y_O$ times, the buffer 26c becomes filled up. Here, $Y_O$ represents the initial value of the register Y corresponding to the value of the register ARPCNT. When the buffer 26c becomes full, the judgment whether it is filled up becomes "yes" Y, and the processing ends with this.

Interruption Routine

Figure 13:
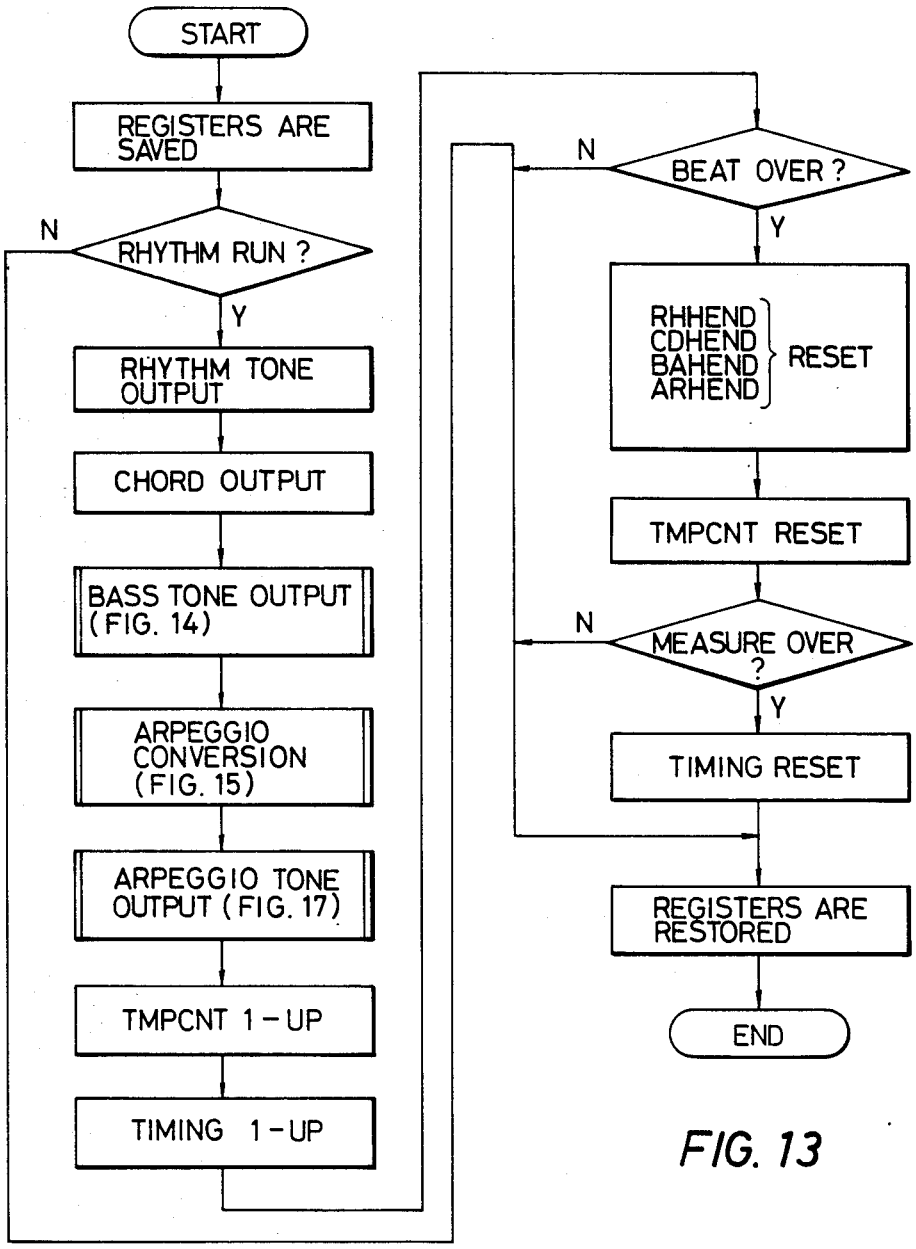
FIG. 13 is a flow chart of interruption routine.

Next, FIG. 13 is referred to now for the description of the interruption routine processing.

As stated above, the tempo timer 76 is arranged to apply interruptions twelve (12) times at equal intervals within a single beat (quarter note length). However, each time a command for interruption is generated, processing will move from the abovesaid main routine to the interruption routine.

In the interruption routine, firstly the contents of the respective registers which have been used in the main routine are saved, and thereafter whether the rhythm run flag RHYRUN is not "0" is checked, and thus judgment is made whether the mode is rhythm run (whether the rhythm start/stop switch is set to its start position). If the result of this judgment is "no" N, processings for generating (sounding) the rhythm tones, chord tones, bass tones and arpeggio tones are not required, and accordingly the contents of the respective registers are restored to end the interruption routine, and with this the processing is returned to the main routine.

If the result of judgment whether the switch is set to "rhythm run" is "yes" Y, the processing will move on to that of outputting the rhythm tones. This processing consists of giving reference to the rhythm pattern memory 24c by making use of the leading address register RHYROM, the address pointer RHPNT, the intra-beat timing counter TMPCNT, and the beat end flag RHHEND, and of supplying, to the rhythm tone forming circuit 74 via the rhythm interface 72, the musical instrument type designation data corresponding to the rhythm instruments (percussion instruments) which are to produce sounds and the sounding controlling data. Whereby, it becomes possible to generate the rhythm tones at given intra-beat timings. It should be noted here that this rhythm tone output processing is similar to the bass tone output processing which will be described later, except that there are no off-timing processing and key-off processing.

Next, the processing moves on to the processing for outputting the chord tones. This processing consists of giving reference to the chord pattern memory 24b by utilizing the leading address register CHDROM, the address pointer CDPNT, the intra-beat timing counter TMPCNT, and the beat-end flag CDHEND, and thereby supplying the chord data set in the chord buffer 26a to the LK music tone forming circuit 42 via the LK interface 40. Whereby, it becomes possible to generate chord tones at given intra-beat timings. It should be noted here that this chord output processing is similar to the bass tone output processing which will be described later, except that no selection of key code data for being sounded is carried out and that the key code data for a plurality of tones are outputted simultaneously.

Next, the bass tone output sub-routine is carried out to enable the generation of bass tones at given intrabeat timings. Its details will be described later with respect to FIGS. 14A and 14B.

Next, a sub-routine of arpeggio conversion and a sub-routine of arpeggio tone output are carried out successively to enable the generation of arpeggio tones at given intra-beat timings, and the details thereof will be described later in connection with FIGS. 15A to 17.

Thereafter, the intra-beat timing counter TMPCNT is upped by one count. And, the intra-measure timing counter TIMING is also upped by one count.

Next, by checking whether the value of the counter TMPCNT has reached "12", judgment is made whether a "beat over" has occurred. If the result of this judgment is "no" N, the contents of the respective registers are restored to return to the main routine. Also, if the result of the judgment whether a "beat over" has occurred is "yes" Y, the beat-end flags RHHEND, CDHEND, BAHEND and ARHEND are reset, respectively, and thereafter the counter TMPCNT is reset.

Thereafter, checking is made whether the value of the counter TIMING is in agreement with the value (which is 36 for 3 beats, and 48 for 4 beats) of the maximum timing register TMPMAX to judge whether there has occurred a "measure over", and if the result of this judgment is "no" N, the contents of the respective registers are restored to return to the main routine. Also, in case the result of judgment whether there has occurred a "measure over" is "yes" Y, the counter TIMING is reset, and thereafter the respective registers are restored to return to the main routine.

According to the above-mentioned interruption routine, it is possible to generate rhythm tones, chord tones, bass tones and arpeggio tones twelve (12) times within a single beat, respectively. However, at which one to be generated is determined by the rhythm pattern, the chord pattern, the bass pattern and the arpeggio pattern, respectively, which are read out from the pattern memory 24 in accordance with the type of the rhythm selected.

Bass Tone Output Sub-routine

Next, bass tone output sub-routine processing will be described by referring to FIGS. 14A and 14B.

Firstly, whether the beat-end flag BAHEND is not "00" in hexadecimal notation is checked to thereby judge whether there is a "beat end". The flag BAHEND is arranged so that "0D" in hexadecimal notation is set at the time of detection of the beat-end flag data, and, on the other hand, "0F" in hexadecimal notation is set at the time of detection of the return flag data. Accordingly, if the result of the judgment whether there is a "beat end" is "yes" Y, this means that either the beat-end flag data or the return flag data has been detected, and if the result is "no" N, it means that none of these flag data has been detected yet.

Let us here assume that the result of the judgment whether there is a "beat end" is "no" N. Whereupon, a pointer value (a relative address within the bass pattern memory 24*a*) is read out from the address pointer BAPNT, and it is inputted in the register Y. And, by adding the value of the register Y to the value of the leading address of the pattern memory area which has been set in the register BASROM in correspondence to the type of the rhythm selected and thus designating an address, there is read out a bass pattern data corresponding to the selected type of rhythm from the bass pattern memory 24*a* and it is inputted in the register A. In this instance, what is written in the register A is the data of the first byte among a set of two bytes, and includes a sounding controlling data (higher three bits) and a sounding timing data (lower four bits).

Next, judgment is made whether there is an agreement between the sounding timing value indicated by the lower four bits of the register A and the value of the intra-beat timing counter TMPCNT. If the result of this judgment is "yes" Y, the pointer value of the register Y is upped by "1".

Next, whether the state flag PKWON is at "1" level is checked, and thus whether the walking bass selection switch is set "on" is judged. If the result is "no" N, the pointer value of the register Y is upped further by "1", and thereafter the pointer value of the register Y is stored in the pointer BAPNT, and with this the processing completes. In case the walking bass selection switch is not turned "on" unlike the above, the value of the pointer BAPNT is set to correspond to the data which is to be read out next.

On the other hand, if the result of the judgment whether the walking bass selection switch is turned "on" is "yes" Y, the processing moves on to that of storing the sounding controlling data. That is, by masking the lower four bits of the register A, the higher three (3)-bit sounding controlling data (tone volume data ACC and mute data M) are derived, and they are stored in the memory section $BASRAM_2$ in the sounding base-/arpeggio data memory 28.

Next, by designating an address by adding the pointer value of the register Y which has been previously upped by "1" to the leading (top) address value of the pattern memory area which has been set in the register BASROM, the bass pattern data is read out from the bass pattern memory 24*a*, and it is loaded in the register A. In this case, what is written in the register A is the data of the second byte among the data of the two bytes, and it includes a tone pitch data (higher four bits) and a tone duration data (lower four bits).

Next, by effecting a 4-bit right-shifting of the data of the register A, the tone pitch data of the higher four bits is derived, and it is inputted in the register X.

As stated above, a tone pitch data indicates either one of the addresses of 0–15 in the bass tone buffer 26*b*. Accordingly, by designating an address by adding the value of the register X to the leading address value BASBF of the buffer 26*b*, a key code data corresponding to the abovesaid tone pitch data is derived from the buffer 26*b*, and it is set in the register A.

Next, the key code data of the register A is transferred to the memory section $BASRAM_1$ in the memory 28, and it is stored therein.

Subsequently, the sounding controlling data of $BASRAM_2$ and the key code data of $BASRAM_1$ are outputted to the bass interface 44. The key code data supplied to the interface 44 is written in the "on-key" code register 46, and it is transferred, by the assignment controlling circuit 50, to a register section in the key code/key-on register 52 and corresponding to the first music tone forming channel. As a result, a key code data corresponding to the bass tone which is to be sounded and a key-on data have been stored in the register section corresponding to the first music tone forming channel, and these data are supplied to the bass tone forming circuit 56. Also, the sounding controlling data which has been supplied to the interface 44 is stored in the sounding controlling data register 54, and it is supplied from this register to the bass tone forming circuit 56. Accordingly, the bass tone forming circuit 56 forms a bass tone signal in the first music tone forming channel in accordance with the key code data, the key-on data and the tone volume data ACC supplied from the interface 44, and in accordance with this bass tone signal, a bass tone is generated from the loudspeaker 38.

Next, the processing will be switched over to the off-timing processing A. In this processing, by first designating an address by adding the pointer value of the register Y to the pattern top address value which has been set in the register BASROM, a bass pattern data is read out again from the bass pattern memory 24*a*, and it is inputted in the register A. At such time, what are inputted in the register A are a tone pitch data and a tone duration data.

Next, by taking an AND of the data of the register A and "F" in hexadecimal notation bit by bit, there is derived a lower four bit tone duration data and it is loaded in the register X. And, as shown in FIG. 2, by assuming the top address value (fixed value) of the note duration table 22*c* as being OFTIME, and by assuming the value (relative address in Table 22*c*) of the register X as being X, and by thus designating an address (OFTIME X), a time length data corresponding to the abovesaid tone duration data is read out from the Table 22*c*, and it is inputted in the register A.

Next, by adding the value of the register A to the value of the intra-measure timing counter TIMING, there is sought an off-timing value, and it is inputted in the register A.

Next, checking is made to see if the value of the register A (off-timing value) is greater than the value (36 if three beats, and 48 if four beats) of the maximum timing register TMPMAX, to judge whether it exceeds the length of one measure. If the result of this judgment is "no" N, the off-timing data of the register A is stored in the memory section $BASRAM_0$ of the memory 28. Also, if the result of the judgment is "yes" Y, the value of the register TMPMAX is subtracted from the value of the register A, to correct the value of the off-timing, and this corrected off-timing data is stored in the memory section $BASRAM_0$. At any rate, the off-timing data which is stored in $BASRAM_0$ indicates the timing of starting a sustain following the starting of sounding the bass tone by an intra-measure timing value (if three beats, either one of 0~35, and if four beats, either one of 0~47).

In the stage after the storage of the off-timing data, the pointer value of the register Y is upped by "1" in a way similar to that for the above-mentioned instance wherein the condition was not "walking bass switch on", and this "1"-upped pointer value is stored in the pointer BAPNT, and the processing ends with this.

The above description represents the processing that, when a certain interruption is applied, a bass pattern data is read out, showing that an agreement in intra-beat timing is obtained (i.e. there is present a bass tone which is to be sounded). However, also when a next interruption is applied, a bass pattern data is read out in a manner similar to that mentioned above, and it is inputted in the register A. The bass pattern data which is read out at such time represents a data next to the preceding read-out data, since the pointer value has been upped by "1" as noted in the lower part of FIG. 14B.

Next, as in the preceding procession, the lower four bits of the register A are compared against the contents of the counter TMPCNT, to judge whether there is an agreement in the intra-beat timing. If the result of this judgment is "no" N, checking is made whether the value of the register A is over "D" in hexadecimal notation, and judgment is made whether there is a flag data (either beat-end flag data or return flag data).

In this instance, if the data of the register A is a sounding timing data, the result of judgment whether there is a flag data will be "no" N, and thus the processing will move over to off-timing deriving. This processing is to derive the off-timing data which has been stored previously in the memory section $BASRAM_0$ of the memory 28 and to load it in the register A.

Next, judgment is made whether the sounding timing value of the register A is in agreement with the value of the intra-measure timing counter TIMING. If the result of this judgment is "no" N, it is considered that the time has not yet come to start a sustain, and thus the processing ends without going to the key-off processing B (FIG. 14B right down).

Thereafter, interruption will be applied several times. However, if no intra-beat timing coincidence nor intra-measure timing coincidence is obtained at any one of the interruptions, the processing will end without passing through a key-off processing B in a manner similar to that mentioned above. And, during the period in which interruption is repeated as stated above, the value of the intra-measure timing counter TIMING continues to increase, and accordingly there will come eventually a time at which an agreement in intra-measure timing is obtained.

When a coincidence in intra-measure timing is obtained, the processing will move on to the key-off processing B. That is, a key code data which has been previously stored in the memory section $BASRAM_1$ of the memory 28 is derived, and it is inputted in the register A. Next, checking is made whether the register A is not "0" to judge whether there is a key code data. Usually, the result of this judgment is "yes" Y, and thus the key code data of the register A is outputted to the bass interface 44. The key code data which has been supplied to the interface 44 is stored in the off-key code register 48, and is transferred by the assignment controlling circuit 50 to the register section within the register 52 and corresponding to the first music tone forming channel. As a result, in the register section corresponding to the first music tone forming channel, the key-on data which has been previously stored is substituted by a key-off data, and this key-off data is supplied to the bass tone forming circuit 56.

The bass tone forming circuit 56, upon its receipt of a key-off data, performs a sustain control to gradually decay the amplitude envelope of the bass tone signal which is being generated. Due to this sustain control, the bass tone which is being generated will decay gradually instead of vanishing abruptly. If, in this case, the mute data M which has been stored in the sounding controlling data register 54 is "1", a sustain controlling will be carried out in such a manner that the decay period of the bass tone will become shorter as compared with the instance where that data is "0".

After the sustain control of the bass tone is started in such a manner as mentioned above, "00" in hexadecimal notation is written in the memory section $BASRAM_1$ of the memory 28 to clear the key code data, and with this the processing ends.

In the above-mentioned processing, the data which is read out into the register A is mentioned as being a sounding timing data. In case this is a beat-end flag data (which is "0D" in hexadecimal notation), the operation will become as stated below. That is, since the result of judgment whether there is an agreement in intra-beat timing becomes "no" N, the judgment whether there is a flag data will become "yes" Y. Next, checking is made whether the value of the register A is "0F" in hexadecimal notation and judgment is made whether there is a return flag. Since the result will be "no" N, the beat-end flag data of the register A is set at a beat-end flag BAHEND. And, the pointer value of the register Y is upped by "1", and this one-upped pointer value is set in the pointer BAPNT.

Thereafter, an off-timing data is derived in such a manner similar to that mentioned above, and judgment is made whether there is an agreement in intra-measure timing. If several interruptions are assumed to be required before the start of key-off, the result of said judgment will become "no" N, and with this the processing ends.

Figure 14A:
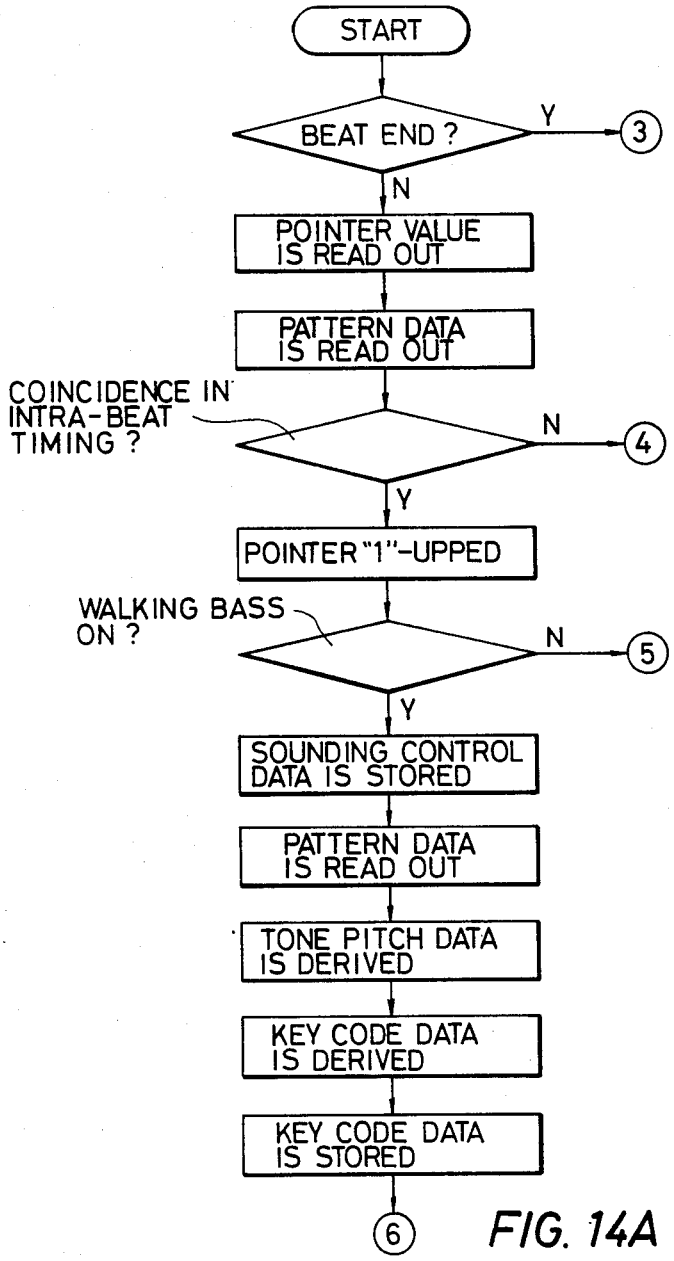
FIGS. 14A and 14B are, in combination, a flow chart of bass tone output sub-routine.

When a next interruption is applied, the judgment whether there is a beat-end shown in the upper part of FIG. 14A becomes "yes" Y. This is because the beat-end flag BAHEND has been set at the time of the preceding interruption.

When the judgment whether there is a beat-end is "yes" Y, an off-timing data is derived as in the preceding case described above, and a judgment is made whether there is an agreement in the intra-measure timing, but the result of this judgment will become "no" N as in the preceding case, and with this the processing ends.

Figure 14B:
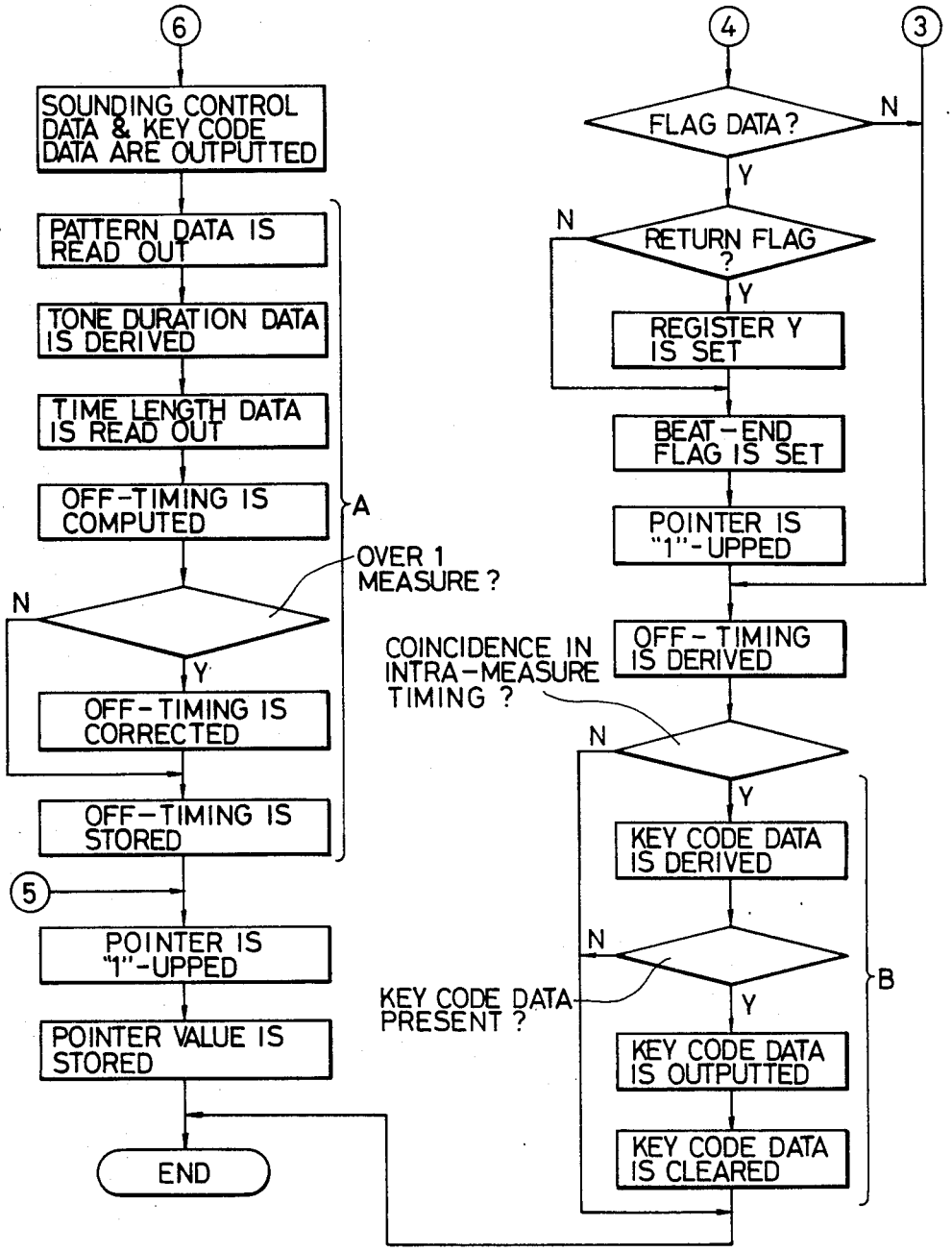

As stated above, once a beat-end flag BAHEND is set, the routine of FIGS. 14A and 14B will become terminated substantially with a brief processing including the deriving of the off-timing data and also the judgment on an agreement of the intra-measure timing. Such a brief processing is repeated until the count value of the intrabeat timing counter TMPCNT becomes "12" and thus until the beat-end flag BAHEND is reset in the routine of FIG. 13. It should be understood that during the period in which such a brief processing is repeated, the intra-measure timing counter TIMING continues to show an increase in its count value for each interruption alike the counter TMPCNT, and accordingly, when an agreement of intra-measure timing is obtained, there will be carried out a key-off processing B in the same way as that described above.

When, after the beat-end flag BAHEND is reset in the routine of FIG. 13, a next interruption is applied, the judgment whether there is a beat-end as shown in the upper part of FIG. 14A becomes "no" N, and there is performed a read-out of a pattern data in the same way as described above. In this case, since the value of the pointer BAPNT has been upped by "1" after the above-mentioned setting of the beat-end flag, there is read out a sounding controlling and sounding timing data next to the beat-end flag data. Based on this read-out data, there is made a judgment whether there is an agreement in intra-beat timing. If the result of this judgment is "yes" Y, a sounding controlling data is written in the memory section $BASRAM_2$ of the memory 28, and concurrently a key code data is written in the memory section $BASRAM_1$ thereof, respectively, in the same way as described above, and they are outputted to the interface 44. In this case, in the interface 44, the assignment controlling circuit 50 assigns a key code data and a key-on data to a register section in the key code/key-on register 52 and corresponding to the second music tone forming channel. Accordingly, the bass tone forming circuit 56 will form a bass tone signal in the second music tone forming channel, and a bass tone corresponding to this bass tone signal is sounded from the loudspeaker 38.

As described above, the current bass tone signal is formed in a music tone forming channel which is different from the channel for the preceding bass tone signal, and therefore, the current bass tone can be sounded out during the period in which the preceding bass tone is sustained.

Thereafter, in a manner similar to that described above for the preceding case, there are performed such processings as the off-timing processing B and the pointer value upping processing.

And, when there is obtained an agreement of intrameasure timing at the end of several times of interruption, there is performed a key-off processing B for the current bass tone.

During the course of progress of the bass tone generating operation in such a manner as described above, there is read out a return flag data into the register A from the bass pattern memory **24*a***. The judgment made then whether there is an agreement of intra-beat timing will be "no" N. A further judgment whether there is a flag data will give "yes" Y. Next, checking is made whether the value of the register A is "0F" in hexadecimal notation to judge whether there is a return flag data. Since the result of judgment is "yes" Y, "FF" in hexadecimal notation (data of "1" in all bits) is set in the register Y.

Next, the return flag data of the register A is set in the beat-end flag BAHEND. And, by upping the value of the pointer by "1" by adding "1" to the value ("FF" in hexadecimal notation) of the register Y, the pointer value will become "00" in hexadecimal notation, and this pointer value is set in the pointer BAPNT.

Thereafter, an off-timing data is derived to judge whether there is an agreement of intra-measure timing, and if the result is "no" N, the processing ends at this, but if "yes" Y, the processing will terminate after passing through a key-off processing B.

Since, in the next interruption, the beat-end flag BAHEND having been set, the processing will be similar to that for the above-mentioned beat-end flag setting. Such an operation will be repeated until the beat-end flag BAHEND is reset. And, when the beat-end flag BAHEND is reset, it should be noted that, since the pointer BAPNT is at "00" in hexadecimal notation from the next interruption and onwards, there is read out a bass pattern data from the top address of the bass pattern memory **24*a***, and thereafter, a bass tone generating operation similar to that mentioned above will be repeated.

Sub-routine for Arpeggio Conversion

Next, description will be made of a sub-routine processing for arpeggio conversion by giving reference to FIGS. 15A and 15B.

Firstly, a check is made whether the value of the beat-end flag ARHEND is not "00" in hexadecimal notation, and "0D" in hexadecimal notation is set at the time of detection of a beat-end flag data, and concurrently "0F" in hexadecimal notation is set at the time of detection of a return flag data. If the result of judgment whether there is a beat-end is "yes" Y, this means that a beat-end flag data or a return flag data has been detected. If the result is "no" N, it means that none of these data has been detected.

Assuming that the result of judgment whether there is a beat-end is "no" N, a pointer value (a relative address in the arpeggio pattern memory **24*d*) is read out from the address pointer ARPNT, and it is inputted in the register Y. And, by designating an address by adding the value of the register Y to the pattern top address value which has been set in the register ARPROM correspondingly to the selected type of rhythm, an arpeggio pattern data corresponding to the selected type of rhythm is read out from the arpeggio pattern memory 24*d***, and it is loaded in the register A. In this case, what is written in the register A is the data of the first byte among the two bytes, and it includes a sounding controlling data (upper four bits) and a sounding timing data (lower four bits).

Next, the data of the register A is transferred over to the register X. And, by taking an AND of the data of the register A and "0F" in hexadecimal notation, there is derived a sounding timing data of the lower four bits, and this is inputted in the register A.

Next, judgment is made whether the value of the register A is in agreement with the value of the intra-beat timing counter TMPCNT. Assuming that the result of this judgment is "yes" Y, checking is then made whether the state flag ARPON is not "00" in hexadecimal notation, and judgment is made whether the arpeggio selection switch is turned "on". If the result of this judgment is "no" N, the processing is done for upping the value of the pointer of the register Y twice, and the operation will return to the reading-out of the pattern data. In this case, the reason for upping the pointer value of the register Y by "2" is that, since the arpeggio pattern data is stored as a set of two bytes, it is necessary to advance the address value by "2" in order to read out the data which is in the first byte among the next two bytes forming another set.

Thereafter, in a manner similar to that described above, an arpeggio pattern data is read out. Then, by comparing the value indicated by the sounding timing data among the data thus read out, against the value of the counter TMPCNT to judge whether there is an agreement of intra-beat timing, and if the result of this judgment is "yes" Y, another judgment is made whether there is an "arpeggio-on", and if this result is "no" N, the pointer value is upped again by "2".

Such a pointer value upping operation can be repeated up to four (4) times at most so long as there is obtained an agreement of intra-beat timing and also so long as the state of the switch is not "arpeggio-on". That is, in this instant embodiment, there are provided four (4) music tone forming channels for arpeggio, and it is possible to sound at most four (4) arpeggio tones simultaneously at a given intra-beat timing. Therefore, in the arpeggio pattern data, there is the possibility that data of two bytes as a set at a same intra-beat timing are contained for four (4) tones. In such a case, the operation as mentioned above is repeated four (4) times, and the pointer value will advance by eight (8).

Now, let us here assume that the result of the above-said judgment whether there is the "arpeggio-on" is "yes" Y. Then, the contents of the register X are transferred over to the register A, and thereafter a scanning of channels is performed. This is to judge which one of the four (4) music tone forming channels is pointed to by the channel data CH contained in the arpeggio pattern data. Thus, judgment is made first whether it is the first channel. If the result of judgment is "no" N, judgment is made whether it is the second channel, and if the result is "no" N, judgment is made whether it is the third channel, and if the result is again "no" N, the channel in question is judged to be the fourth channel.

Concretely speaking, as shown in FIG. 3, a channel data CH is comprised of the second and third bits as counted from the highest bit in one byte (consisting of eight bits), and they are provided with "00", "01" "10" and "11" binary codes corresponding to the channels of 1, 2, 3 and 4, respectively. In case of the judgment whether it is the first channel, an AND of the data of the register A and "60" in hexadecimal notation (=01100000 in binary) is taken to check whether the result will be "00" in hexadecimal notation. In case of the judgment whether it is the second channel, an AND of the data of the register A and the hexadecimal "40" (=binary 01000000) is taken to check whether it will be hexadeximal "00". In case of the judgment whether it is the third channel, an AND of the data of the register A and the hexadecimal "20" (=binary 00100000) is taken to check whether it will be hexadecimal "00".

If, as the result of the abovesaid judgment of channel, the first channel is the result, hexadecimal "00" is inputted in the register ARCH. If the result of judgment is the second channel, hexadecimal "04" is inputted in ARCH. If the result is noted to be the third channel, hexadecimal "08" is inputted in ARCH. If the channel is judged to be the fourth one (meaning that it is judged as not being the third channel), hexadecimal "0C" is inputted in ARCH.

After having inputted a channel-designating data in the register ARCH in such a manner as described above, the processing will move on to an arpeggio tone storing sub-routine. This sub-routine is intended to store arpeggio data in the memory sections ($ARPRAM_0$-~$ARPRAM_3$, $ARPRAM_4$~$ARPRAM_7$, $ARPRAM_8$-~$ARPRAM_{11}$ or $ARPRAM_{12}$~$ARPRAM_{15}$) contained in the sounding bass/arpeggio data memory 28 and corresponding to the channel indicated by the register ARCH. The details thereof will be described later with respect to FIG. 16. It should be noted here that, in the arpeggio tone storing sub-routine, the pointer value of the register Y is upped by "2".

Upon completion of the arpeggio tone storing sub-routine, the processing returns to the reading-out of a pattern data. There, a next arpeggio pattern data is read out, and as in the preceding case, judgment is made whether there is an agreement of intra-beat timing, and if the result is "yes" Y, a judgment whether there is "arpeggio-on" is made, and if the result is "yes" Y, there is performed the judgment of channel, and also the setting to the register ARCH is carried out. These operations, like the abovesaid pointer value upping operation in case there is no arpeggio-on, can be repeated four (4) times at most so long as there is obtained intra-beat timing agreement and so long as there is the judgment of arpeggio-on.

The above processing is one for an instance such that, when the arpeggio pattern data is read out when a certain interruption is applied, there is found an agreement in intra-beat timing (i.e. there is noted the presence of an arpeggio tone which is to be sounded). However, the operation where there is not obtained an agreement in intra-beat timing will be as follows. That is, since the result of judgment whether there is an agreement in intra-beat timing will be "no" N, checking is made whether the value of the register A is above hexadecimal "0D", and judgment is made whether there is a flag data (beat-end flag data or return flag data). If the result of this judgment is "no" N, the processing ends.

On the other hand, in case the result of the judgment whether there is a flag data is "yes" Y, checking is made whether the value of the register A is hexadecimal "0F", and judgment is made whether there is a return flag data. If the result is "no" N, the data of the register A, which is a beat-end flag data ("0D" in hexadecimal notation), is set in the beat-end flag ARHEND. And, the pointer value of the register Y is upped by "1", and this "1"-upped pointer value is set in the pointer ARPNT, and ends the processing. Also, if the result of the judgment whether there is a return flag is "yes" Y, hexadecimal "FF" is set in the register Y, and thereafter the return flag data (hexadecimal "0F") of the register A is set in the beat-end flag ARHEND. And, by upping the value of the register Y by "1", the data will become hexadecimal "00". By setting this value in the pointer ARPNT, the processing ends.

Figure 15A:
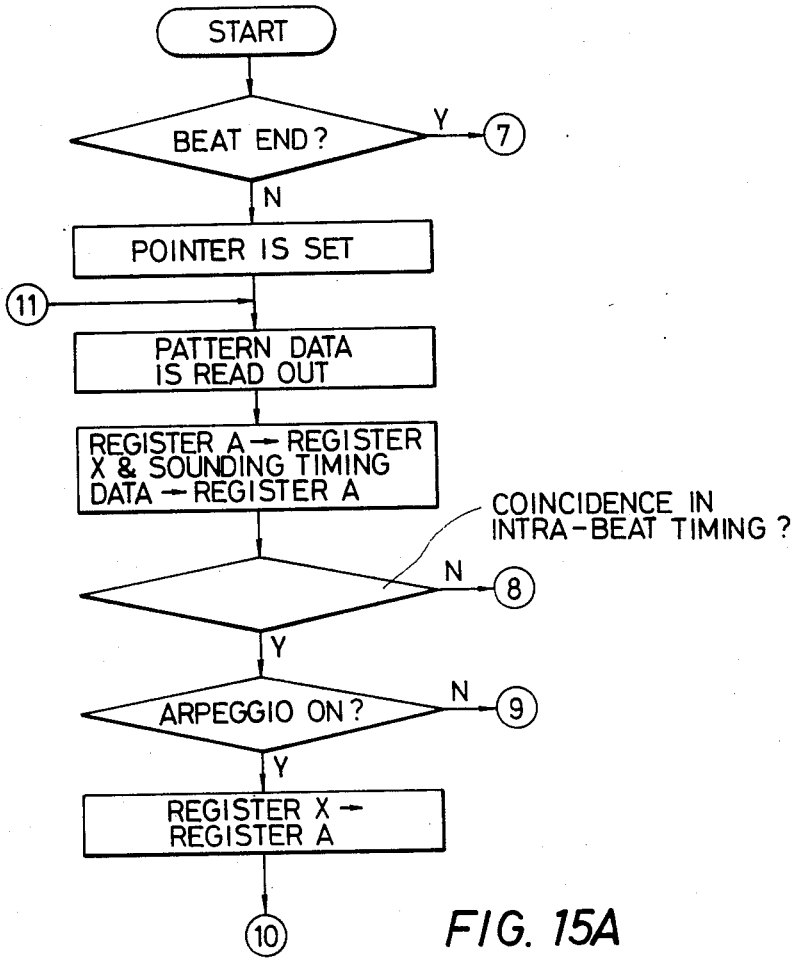
FIGS. 15A and 15B are, in combination, a flow chart of arpeggio conversion sub-routine.
Figure 15B:
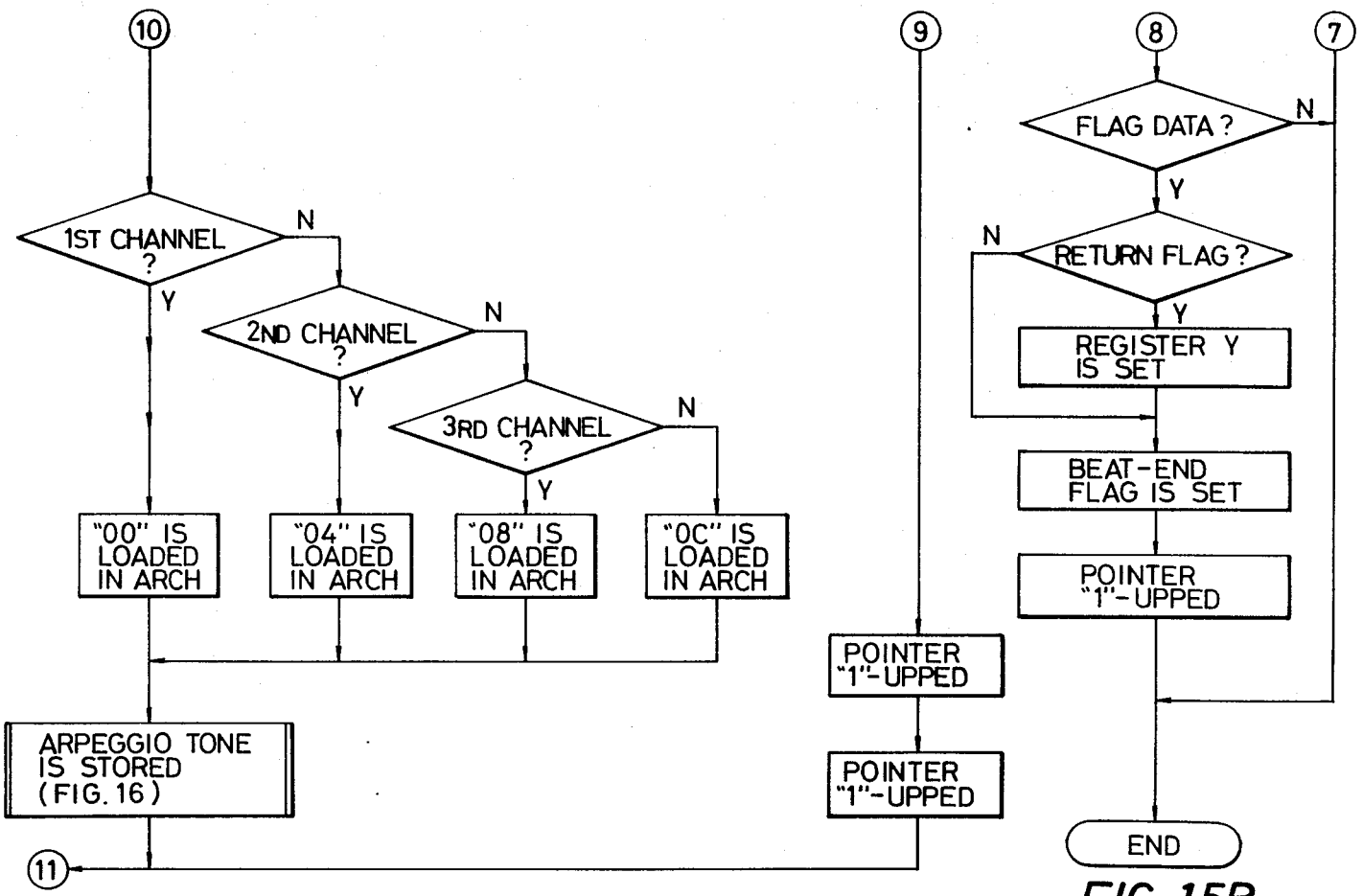

When either a beat-end flag data or a return flag data is set in the beat-end flag ARHEND as stated above, the result of judgment whether there is a beat-end in the upper part of FIG. 15A will become "yes" Y at the next interruption, and the sub-routine mentioned in FIGS. 15A and 15B ends with this. Such an operation is repeated until the count value of the counter TMPCNT reaches "12" and until the beat-end flag ARHEND is reset in the sub-routine of FIG. 13.

When the beat-end flag ARHEND is reset, the result of judgment whether there is a beat-end will become "no" N at the next interruption, and accordingly there is read out, as an arpeggio pattern data, either a data next to the beat-end flag data or a leading address data. Subsequently, such an operation as described above is repeated depending on whether or an not intra-beat timing agreement exists or whether or not arpeggio-on.

Arpeggio Tone Storing Sub-routine

Figure 16:
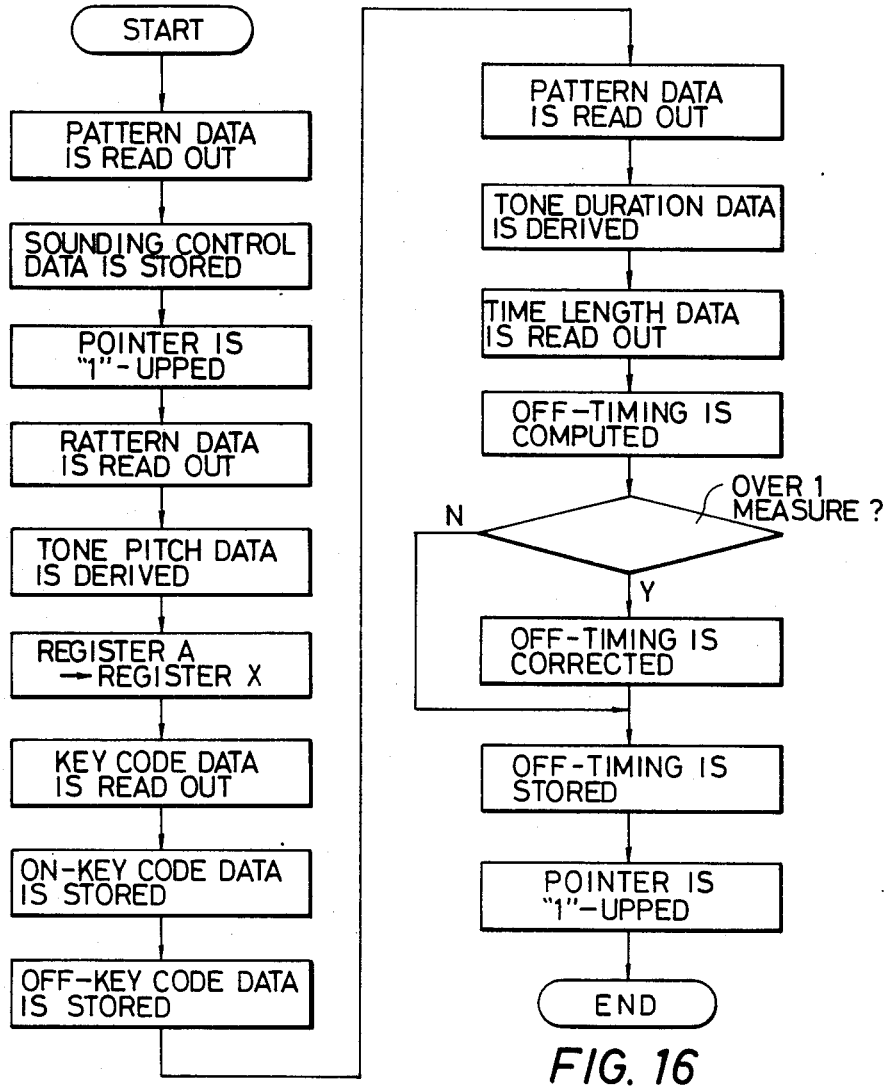
FIG. 16 is a flow chart of arpeggio tone storage sub-routine.

Next, FIG. 16 is referred to for the description of arpeggio tone storing sub-routine.

Firstly, by designating an address by adding the value of the register Y to the pattern top address value which is set in the register ARPROM in correspondence to the selected type of rhythm, there is read out an arpeggio pattern data corresponding to the selected type of rhythm from the arpeggio pattern memory **24*d*, and it is inputted in the register A. The one-byte data which is entered in the register A at such time contains the sounding timing data (lower four bits) for which an intra-beat timing agreement has been obtained in the routine of FIG. 15** and also a sounding controlling data (higher four bits) associated with the above-mentioned data.

Then, by designating an address (ARM+ACH+3) by assuming that the top address value (fixed value) of the arpeggio data memory section is ARM as shown in FIG. 5, and that the value of the channel designating data in the register ARCH is ACH, the sounding controlling data (tone volume data ACC, channel data CH and mute data M) which is derived from the register A is stored in the memory section ($ARPRAM_3$, $ARPRAM_7$, $ARPRAM_{11}$ or $ARPRAM_{15}$) corresponding to the designated channel.

Next, after upping the pointer value of the register Y by "1", and by designating an address by adding the pointer value of the register Y to the pattern top address value which has been set in the register ARPROM, there is read out an arpeggio pattern data from the memory **24*d***, and it is inputted in the register A. At such time, the one-byte data which is set in the register A is one next to the one-byte data which has been read out precedingly thereto, and it contains a tone pitch data (higher four bits) and a tone duration data (lower four bits).

Next, by shifting the data of the register A by four bits toward the right, a tone pitch data of higher four (4) bits is derived, and this tone pitch data is transferred from the register A to the register X. Here, the tone pitch data is indicative of either one of the address of 0~15 in the arpeggio tone buffer **26*c***.

Next, as shown in FIG. 4, the leading (top) address of the arpeggio buffer **26*c*** is assumed to be ARPBF, and the value of the register X as X, and an address (ARPBF+X) is designated, whereby a key code data corresponding to the abovesaid tone pitch data is read out, and it is inputted in the register A.

Next, the key code data of the register A is stored, as an "on-key code data", in a memory section ($ARPRAM_0$, $ARPRAM_4$, $ARPRAM_8$ or $ARPRAM_{12}$) corresponding to the designated channel by designating an address (ARM+ACH+0).

Next, by designating an address (ARM+ACH+2), the key code data of the register A is sorted, as an off-key code data, in a memory section ($ARPRAM_2$, $ARPRAM_6$, $ARPRAM_{10}$ or $ARPRAM_{14}$) corresponding to the designated channel.

Next, by performing an address designation by adding the pointer value of the register Y to the pattern top address value which has been set in the register ARPROM, there is read out from the memory **24*d*** an arpeggio pattern data (tone pitch and tone duration data) same as that in the preceding step, and it is inputted in the register A. And, by taking an AND of the data of the register A and hexadecimal "F", there is derived a tone duration data of the lower four (4) bits, and it is inputted in the register X.

Next, in a manner similar to that described above in connection with the bass tone output routine, an address (OFTIME+X) is designated, and whereby there is read out a time length data corresponding to the above-said tone duration data from the note duration table **22*c***, and it is loaded in the register A.

Next, the value of the register A is added to the value of the intra-measure timing counter TIMING, to seek the off-timing value, and it is inputted in the register A.

Next, checking is made whether the value of the register A (off-timing value) is greater than the value (if three beats, 36 and if four beats, 48) of the maximum timing register TMPMAX, to judge whether it exceeds one measure. If the result of this judgment is "no" N, the off-timing data of the register A is stored in a memory section ($ARPRAM_1$, $ARPRAM_5$, $ARPRAM_9$ or $ARPRAM_{13}$) corresponding to the designated channel by designating an address (ARM+ACH+1). Also, if the result of judgement is "yes" Y, the value of the register TMPMAX is subtracted from the value of the register Y to correct the off-timing value, and in a same manner as described above, this corrected off-timing value is stored in a memory section at the address (ARM+ACH+1). In any case, the off-timing data stored in the memory section at the address (ARM+ACH+1) indicates the timing at which a sustain is to be started of the arpeggio tone after its sounding has been started, by an intra-measure timing value (which, if in three beats, is either one of 0~35, and if in four beats, either one of 0~47).

After the storage of the off-timing data, the pointer value of the register Y is upped by "1", and with this the processing ends. By this upping of the pointer value, it will be noted that, in the sub-routine of FIG. 16, the pointer value has undergone an upping by "2". Thus, in case the processing returns to the sub-routine of FIGS. 15A and 15B, it becomes possible to read out the first byte of data (sounding controlling and sounding timing data) in the next two bytes forming a pair.

It should be understood here that the sub-routine of FIG. 16 can be carried out a plurality of times even at a single interruption. That is, let us now assume that there have been obtained intra-beat timing agreement at a plurality of times (four times at most) for plural arpeggio tones in FIGS. 15A and 15B. The sub-routine of FIG. 16 will be carried out a plurality of times corresponding to the number of times of the intra-beat timing agreement.

Arpeggio Tone Output Sub-Routine

Figure 17:
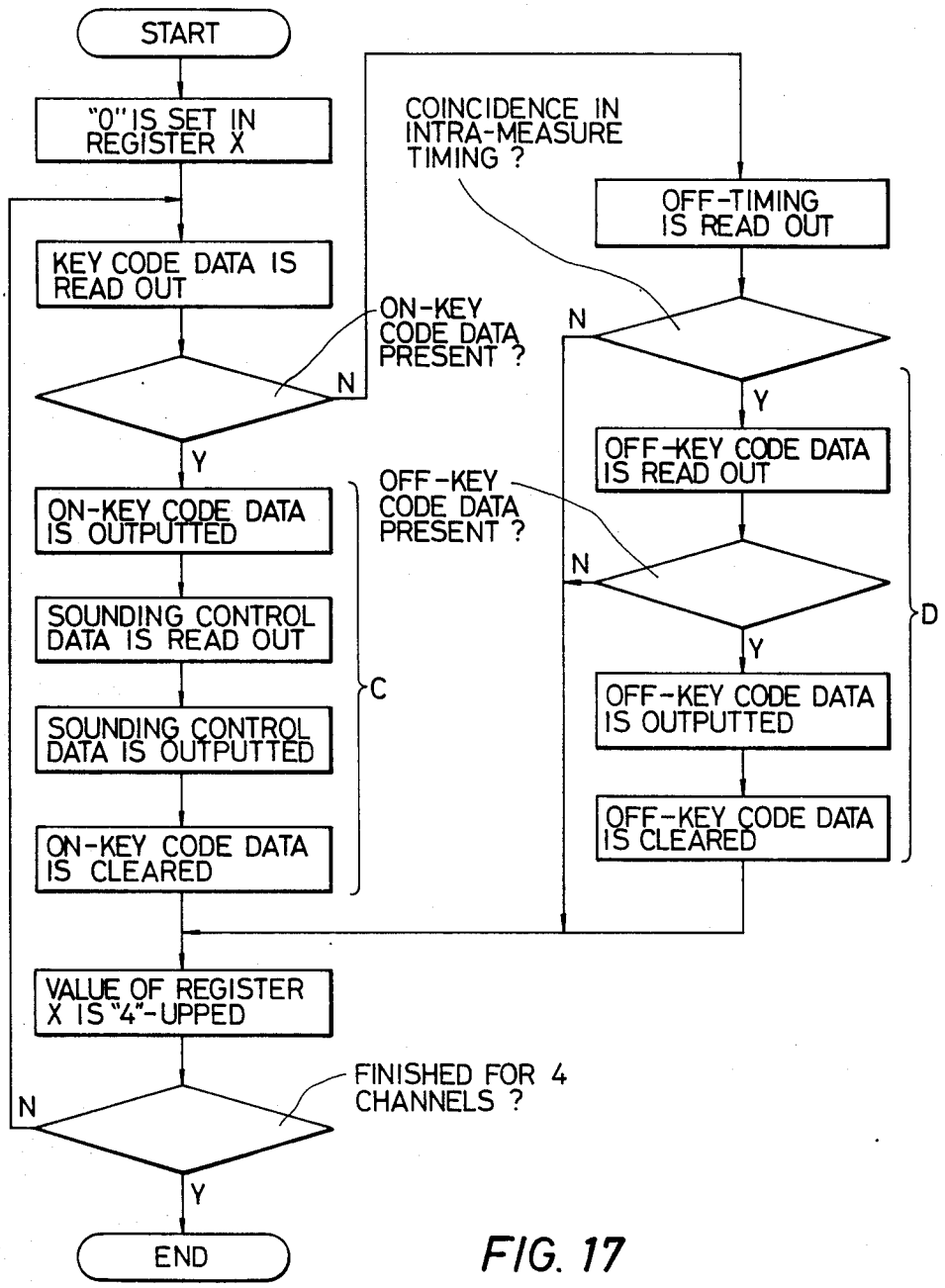
FIG. 17 is a flow chart of arpeggio tone output sub-routine.

Next, by referring to FIG. 17, description will be made of the arpeggio tone output sub-routine processing.

As a first step, hexadecimal "00" is written in the register X to set a digital value 0 therein. And, by designating an address (ARM+X+0), an on-key code data is derived from the memory section $ARPRAM_0$ corresponding to the first channel, and it is inputted in the register A.

Next, checking is made whether the value of the register A is not hexadecimal "00", to judge whether there is an on-key code data, and if the result is "yes" Y, the step will move on to the key-on processing route C. In this processing, the on-key code data of the register A is outputted to the arpeggio interface 58. The on-key code data which is supplied to the interface 58 is written in the on-key code register 60.

Next, by designating an address (ARM+X+3), a sounding controlling data is read out from a memory section $ARPRAM_3$ corresponding to the first channel, and it is loaded in the register A. And, the sounding controlling data of the register A is outputted to the interface 58. The sounding controlling data which has been supplied to the interface 58 is written in the sounding controlling data register 68.

In the interface 58, the assignment controlling circuit 64 assigns the on-key code data of the register 60 to the channel indicated by the channel data CH contained in the sounding controlling data of the register 68. That is, in this instance, a key-code data and a key-on data of the tone to be sounded are stored in the register section of the key code/key-on register 66 corresponding to the first channel, and these data are supplied to the arpeggio tone forming circuit 70. Also, to the arpeggio tone forming circuit 70, there are supplied a tone volume data ACC and a mute data M from the register 68. As a result, the arpeggio tone forming circuit 70 forms an arpeggio tone signal in the first music tone forming channel in accordance with the keycode data, the key-on data and the tone volume data ACC supplied from the interface 58, and in accordance with this arpeggio tone signal, and arpeggio tone is generated from the loudspeaker 38.

After the abovesaid sounding controlling data output processing, an address (ARM+X+0) is designated to write hexadecimal "00" in the memory section $ARPROM_0$, and thereby the on-key code data is cleared. And, after upping the value of the register X by "4", checking is made whether the value of the register X is greater than hexadecimal "0C", and a judgment is made whether the processing has been completed for the four channels. In the embodiment mentioned above, however, the processing for only one channel has been completed so far, and the result of judgment becomes "no" N, and the processing returns to the reading-out of the on-key code data.

Thereafter, so long as the judgment is made that there is an on-key code data, the above-said key-on processing C is performed for the remaining second-to fourth channels (and accordingly, simultaneous sounding of up to four tones can be made at a given intra-beat timing). If, however, there is no on-key code data corresponding to the second-to-fourth channels, the result of judgment whether there is an on-key code data present after reading out an on-key code data corresponding to the second channel, will become "no" N.

In such an instance, an address (ARM+X+1) is designated to read out an off-timing data from the memory section $ARPRAM_5$ corresponding to the second channel, and it is inputted in the register A. And, a judgment is made whether there is an agreement between the value of the register A and the value of the intra-measure timing counter TIMING.

If the result of this judgment is "no" N, the value of the register X is upped by "4" as in the preceding case, and an on-key code data corresponding to the third channel is read out, to judge whether there is an on-key code data present. Since the result of this judgment becomes "no" N, there is read out an off-timing data corresponding to the third channel in the same way as described above, and thus a judgment is made whether there is an agreement in the intra-measure timing.

If the result of this judgment is "no" N, an operation similar to that mentioned above with respect to the data corresponding to the third channel is performed for the data corresponding to the fourth channel. In this case, by upping the value of the register X by "4" after the result of judgment whether there is an agreement in the intra-measure timing has become "no" N, it will be noted that, since the value of the register X is greater than hexadecimal "0C", the result of judgment whether the processing for the four (4) channels has ended becomes "yes" Y, and thus the processing ends.

In case there is no key-code data corresponding to the first channel in the above-mentioned embodiment, there is performed no key-on processing C, and the processing completes after performing four times such steps as the off-timing reading-out and the intra-measure timing agreement judgment.

What is described above is a processing wherein a given interruption is applied. In case, however, when interruptions have been applied several times thereafter, the result of judgment whether there is an agreement in the intra-measure timing with respect to the off-timing data corresponding to the first channel is to become "yes" Y, the processing will move over to a key-off processing D. In this latter processing, firstly an address (ARM+X+2) is designated to read out an off-key code data from the memory section $ARPRAM_2$ corresponding to the first channel, and it is inputted in the register A. And, checking is made whether the value of the register A is not hexadecimal "00" to judge whether there is an off-key code data present. Usually, the result of this judgment is "yes" Y, and accordingly, the off-key code data of the register A is outputted to the arpeggio interface 58. The off-key code data which has been supplied to the interface 58 is stored in the off-key code register 62, and by the assignment controlling circuit 64, it is transferred to the register section in the register 66 and corresponding to the first channel. As a result, in the register section corresponding to the first channel, the key-on data which has been previously stored is substituted by a key-off data, and this latter key-off data is supplied to the arpeggio tone forming circuit 70.

The arpeggio tone forming circuit 70, upon its receipt of a key-off data, performs a sustain (decaying) controlling of the arpeggio tone signal which is being formed in the first music tone forming channel. As a result, the arpeggio tone corresponding to the first channel and being sounded will decay gradually. It should be understood here that, in this sustain controlling step, the mute data M which is stored in the register 68 is utilized as in the case of the sustain controlling of bass tones described already.

After the abovesaid off-key code data output processing, an address (ARM+X+2) is designated to write hexadecimal "00" in the memory section $ARPRAM_2$ to thereby clear the off-key code data.

Next, the value of the register X is upped by "4", and the on-key code data corresponding to the second channel is read out, and a judgment whether there is an on-key code data present is made. If the result of this judgment is "yes" Y, an arpeggio tone corresponding to the second channel is generated by a key-on processing C in the same way as has been described above.

Thereafter, with respect to the data corresponding to the third and fourth channels, such processing as mentioned above are performed in accordance with the presence or absence of an on-key code and whether there is an agreement in intra-measure timing.

According to the sub-routines mentioned in FIGS. 15A to 17, not only is it possible to sound such arpeggio tones as $C_2$, $E_2$ and $G_2$ in successive fashion, but also it is possible to sound these tones simultaneously. Also it should be noted that, whichever sounding type is to be taken, key code data for sixteen (16) tones spreading over a plurality of octaves are stored in the arpeggio buffer 26c, and accordingly, by appropriately setting the contents of the arpeggio pattern data, it becomes possible to make an automatic arpeggio performance of concurrent plural tones which are shifted by octaves such as $C_2+E_2+G_2$, then $C_3+E_3+G_3$, and then $C_4+E_4+G_4$.

What is claimed is:

1. An automatic accompaniment apparatus for an electronic musical instrument, comprising:

a keyboard including keys;

time divisional data processing means which forms at a first time division depressed key data representing respective keys depressed on said keyboard, forms at a second time division a plurality of key data corresponding to the actual accompaniment tones to be possibly sounded based on said depressed key data generates at a third time division a sounding timing signal for instructing timings for sounding of accompaniment tones, and reads out at a fourth time division key data for said accompaniment tones to be sounded from hereinbelow said memory means by selectively designing addresses in said memory regions in response to said sounding timing signal;

memory means for storing said plurality of key data in separate memory regions, respectively; and means for generating accompaniment tone signals based on the respective key data thus read out.

2. An automatic accompaniment apparatus for an electronic musical instrument according to claim 1, wherein:

said keyboard is one intended for accompaniment, and said time divisional data processing means includes means for detecting a chord name based on said depressed key data, and is arranged to form said plurality of key data in accordance with a chord name detected.

3. An automatic accompaniment apparatus for an electronic musical instrument according to claim 1, wherein:

said keyboard is one intended for accompaniment, and said time divisional data processing means is arranged to form said plurality of key data over a plurality of octaves by associating said key data with note names based on the depressed key data corresponding to a plurality of keys depressed on said keyboard.

4. An automatic accompaniment apparatus for an electronic musical instrument, comprising:

a keyboard including keys;

time divisional data processing means which forms at a first time division depressed key data representing respective keys depressed on said keyboard, forms at a second time division a plurality of key data corresponding to the actual accompaniment tones to be possibly sounded based on said depressed key data, generates at a third time division a sounding timing signal for instructing timings for sounding of accompaniment tones, and reads out a fourth time division key data for said accompaniment tones to be sounded from hereinbelow said first memory means by selectively designating addresses in said memory regions in response to said sounding timing signal;

first memory means for storing said plurality of key data in separate memory regions, respectively;

second memory means for storing accompaniment pattern data containing sounding timing data and address designation data for respectively accompaniment tones to be sounded;

means for generating a tempo signal;

said time divisional data processing means having an operation for reading out said accompaniment pattern data from said second memory means, and when there is a sounding timing data corresponding to the timing of said reading-out, for reading out a key data from a memory region whose address in said first memory means has been designated in accordance with an address designation data associated with said sounding timing data; and means for generating accompaniment tone signals in accordance with the key data read out.

5. An automatic accompaniment apparatus for an electronic musical instrument according to claim 4, wherein:

the accompaniment papptern data stored in said second memory means contains at least one of a tone color, a tone volume and a sounding time for each of the accompaniment tones to be sounded, and said accompaniment tone signal generating means receives said sounding controlling data from said time divisional data processing means to control at least one of the tone color, the tone volume and the sounding timing for said accompaniment tone signal.

6. An automatic accompaniment apparatus for an electronic musical instrument, comprising:

an accompaniment keyboard;

a single data processor used on a time divisional basis separately to form at a first time division depressed key data representing respective keys depressed on said keyboard, to form at a second time division accompaniment key data corresponding to the actual accompaniment tones and having a possibility of being generated based on said depressed key data, to generate at a third time division a tempo signal for applying an interruption to said data processor to enable, for a predetermined length of time, an operation of said data processor for generating an accompaniment tone data every one-integerth of one beat, and to generate accompaniment tone data by selecting and outputting key data from among said accompaniment key data at respective accompaniment tone generating timings that are synchronous with a rhythm to be performed; and means for generating accompaniment tone signals utilizing without further computation, the respective accompaniment tone data generated at said second time division.

7. In an electronic musical instrument of the type providing a plurality of automatic accompaniment effects, and in which tones are generated in accordance with provided key codes, the automatic accompaniment notes being established in response to depressed key data, the improvement comprising:

precomputation means for precomputing, at each time that said depressed key data changes, a set of note codes representing all actual accompaniment notes to be possibly sounded based on said depressed key data, and accompaniment tone sounding means for selecting and utilizing said precomputed note codes at appropriate accompaniment timings to produce the musical notes corresponding thereto without further modification of said note codes.

8. An automatic accompaniment apparatus for an electronic musical instrument according to claim 7, wherein said precomputation means includes a memory means for storing said complete note codes for all accompaniment notes to be possibly sounded.

9. An automatic accompaniment apparatus for an electronic musical instrument, comprising:

a keyboard including keys;

a single microprocessor; and means for utilizing said single microprocessor, on a time-shared basis for time sequential execution of different programs respectively (a) to detect newly depressed keys, (b) to precompute, upon detection of a new depressed key, a set of note codes representing all actual accompaniment tones to be possibly sounded in accordance with that detected newly depressed key, and (c) at rhythmic timing intervals to select a note code from said set and produce an accompaniment tone corresponding thereto without further modification of said note codes.

10. An automatic accompaniment apparatus according to claim 6 wherein said formed accompaniment key data consists of complete accompaniment key codes for all notes having a possibility of being generated based on said depressed key data.

11. An automatic accompaniment apparatus for an electronic musical instrument according to claim 7 wherein said precomputation means and said tone sounding means both utilize a single microcomputer on a time division basis, and wherein said tone sounding means carries out said selecting in a duration of time that is shorter than the time duration taken by said precomputation means to precompute said set of complete note codes.

* * * * *